United States Patent [19]

Yamada

[11] Patent Number: 4,916,487

[45] Date of Patent: Apr. 10, 1990

[54] IMAGE FORMING APPARATUS

[75] Inventor: Hirokazu Yamada, Azuchi, Japan

[73] Assignee: Minolta Camera Kabushiki Kaisha, Osaka, Japan

[21] Appl. No.: 219,999

[22] Filed: Jul. 15, 1988

[30] Foreign Application Priority Data

| | | | |
|---|---|---|---|
| Jul. 15, 1987 | [JP] | Japan | 62-176553 |
| Jul. 15, 1987 | [JP] | Japan | 62-176554 |
| Jul. 15, 1987 | [JP] | Japan | 62-176555 |
| Jul. 15, 1987 | [JP] | Japan | 62-176556 |
| Jul. 15, 1987 | [JP] | Japan | 62-176557 |
| Jul. 15, 1987 | [JP] | Japan | 62-176558 |
| May 13, 1988 | [JP] | Japan | 63-117196 |

[51] Int. Cl.[4] ..... G03G 15/00

[52] U.S. Cl. ..... 355/208; 355/214; 355/243; 355/246; 355/69

[58] Field of Search ..... 355/69, 83, 203, 204, 355/205, 206, 207, 208, 209, 214, 243, 246, 265, 311, 313, 314; 364/900; 340/706, 713

[56] References Cited

U.S. PATENT DOCUMENTS

| | | | |
|---|---|---|---|
| 4,320,964 | 3/1982 | Ishida et al. | 355/69 |
| 4,375,917 | 3/1983 | Hiraike et al. | 355/208 |
| 4,393,375 | 7/1983 | Sugiura et al. | 355/209 X |
| 4,394,087 | 7/1983 | Irie et al. | 355/314 |
| 4,542,985 | 9/1985 | Honma et al. | 355/69 |
| 4,564,287 | 1/1986 | Suzuki et al. | 355/208 |
| 4,636,963 | 1/1987 | Nakajima et al. | 340/706 X |
| 4,699,502 | 10/1987 | Araki et al. | 355/69 X |
| 4,711,566 | 12/1987 | Evans | 355/69 X |
| 4,764,789 | 8/1988 | Iwaki et al. | 340/713 X |
| 4,777,483 | 10/1988 | Fowler | 340/706 |
| 4,839,698 | 6/1989 | Inuzuka et al. | 355/243 |
| 4,857,960 | 8/1989 | Hosaka et al. | 355/208 |

*Primary Examiner*—A. C. Prescott

*Attorney, Agent, or Firm*—Price, Gess & Ubell

[57] ABSTRACT

An image forming apparatus includes an image forming device for forming an image on a copying paper, an operable input device which is rotatable and is connected with a rotary encoder which outputs a pulse signal in response to rotation of the operatable input device, a condition setting device for setting conditions for an image formation of the image in response to the pulse signal outputted from the rotary encoder, and a controller for controlling the image forming device depending on the image forming conditions set by the condition setting device.

Thus, an operator can easily change an operation condition or mode of the copying apparatus from one to another with the input device which is connected with the rotary encoder.

33 Claims, 25 Drawing Sheets

IMAGE FORMING APPARATUS

BACKGROUND OF THE INVENTION

1. Field of the Invention

The present invention generally relates to an image forming copying apparatus such as a copying machine or a printer or the like.

2. Description of the Related Art

In a sort of the image forming apparatus such as an electrophotographic copying machine, an operation panel is usually provided for operating the apparatus, such as changing a copy quantity, a magnification, and an exposure level, or selecting a simplex copy, a duplex copy and/or a composite copy. Furthermore, keys, such as ten-keys, rotation keys, each of which changes states or modes assigned thereto successively and cyclically each depressing thereof, and UP-and DOWN-keys, for doing decision whether a sorter can be used or not are arranged on the operation panel. An operator operates these keys in order to set a various kind of operation mode for copying. On the other hand, apparatuses are available, which are provided with a variable resistor for setting the copy quantity and/or an image density by an operation of sliding or rotating.

For example, the above-mentioned apparatuses with the different arrangements can be found in U.S. Pat. No. 4,320,964, issued on Mar. 23, 1982, U.S. Pat. No. 4,393,375, issued on July 12, 1983, U.S. Pat. No. 4,394,087, issued on July 19, 1983, and U.S. Pat. No. 4,564,287, issued on Jan. 14, 1986.

Although the above-mentioned apparatuses are put to practical use and are under operating, the apparatus having ten-keys for setting the magnification, for example, has a following disadvantage from the point of operational view. That is, in case of setting a suitable magnification with trail and error, an operator must take a key-operation for inputting a new magnification value every time when the magnification would be changed. Therefore, a fine adjustment for a clear copy is very difficult as well as an altering operation is troublesome. In case of setting the magnification with the rotation keys and/or UP- and DOWN-keys, some apparatuses having a setting range of the magnification, which is arranged stepwise have a disadvantage that the setting operation can not be done smoothly.

On the other hand, in accommodating the variable resistor in the apparatus, an adjusting range of the magnification is limited, besides there is a disadvantage that it is necessary to return to a standard position mechanically in the case of automatic resetting or the like since an input value for setting the magnification is an absolute value measured from the standard position.

Furthermore, there is a further disadvantage for the above-mentioned apparatus that a key operation is to be troublesome as well as to get easily into a wrong operation since a different key applies to a different operation mode, i.e., the ten-keys for setting copy quantity, and the rotation key and/or UP- and DOWN-keys for setting the magnification. In other words, respective operations are carried out with corresponding keys.

SUMMARY OF THE INVENTION

Accordingly, an essential object of the present invention is to provide an improved image forming apparatus which can overcome such disadvantages as described above, whereby the apparatus enables a setting operation for respective operation modes to be smooth as well as reliable.

In accomplishing this and other objects, according to preferred embodiments of the present invention, there is provided an improved image forming apparatus which comprises image forming means for forming an image, operable input means which is rotatable and is connected with a rotary encoder outputting a pulse signal in response to rotation of said operable input means, condition setting means for setting conditions for an image formation of the image, which is carried out by said image forming means in response to the pulse signal outputted from the rotary encoder, and control means for controlling image forming means depending on the image forming conditions set by condition setting means.

Thereby, the rotary encoder outputs the pulse signal in accordance with its rotating direction and rotated angle when rotating operatable input means, i.e., making the rotary encoder rotated, to any direction with a certain angle, so that condition setting means responses to the pulse signal and sets the image forming conditions on which image forming means forms the image.

According to the present invention, the image forming conditions can be set by the operation of input means, that is, rotating the rotary encoder with a hand-operation, so as to determine the operation mode, so that it is achieved that the operation for setting a desirable operation mode for forming the image is simple as well as the operation can be made smoothly and reliably.

BRIEF DESCRIPTION OF THE DRAWINGS

These and other objects and feature of the present invention will become apparent from the following description taken in conjunction with the preferred embodiment thereof with reference to the accompanying drawings, in which.

DETAILED DESCRIPTION OF THE INVENTION

An image forming apparatus according to the first embodiment of the present invention will be described with reference to the accompanying drawings of FIGS. 1 through FIG. 20.

Figure 1:
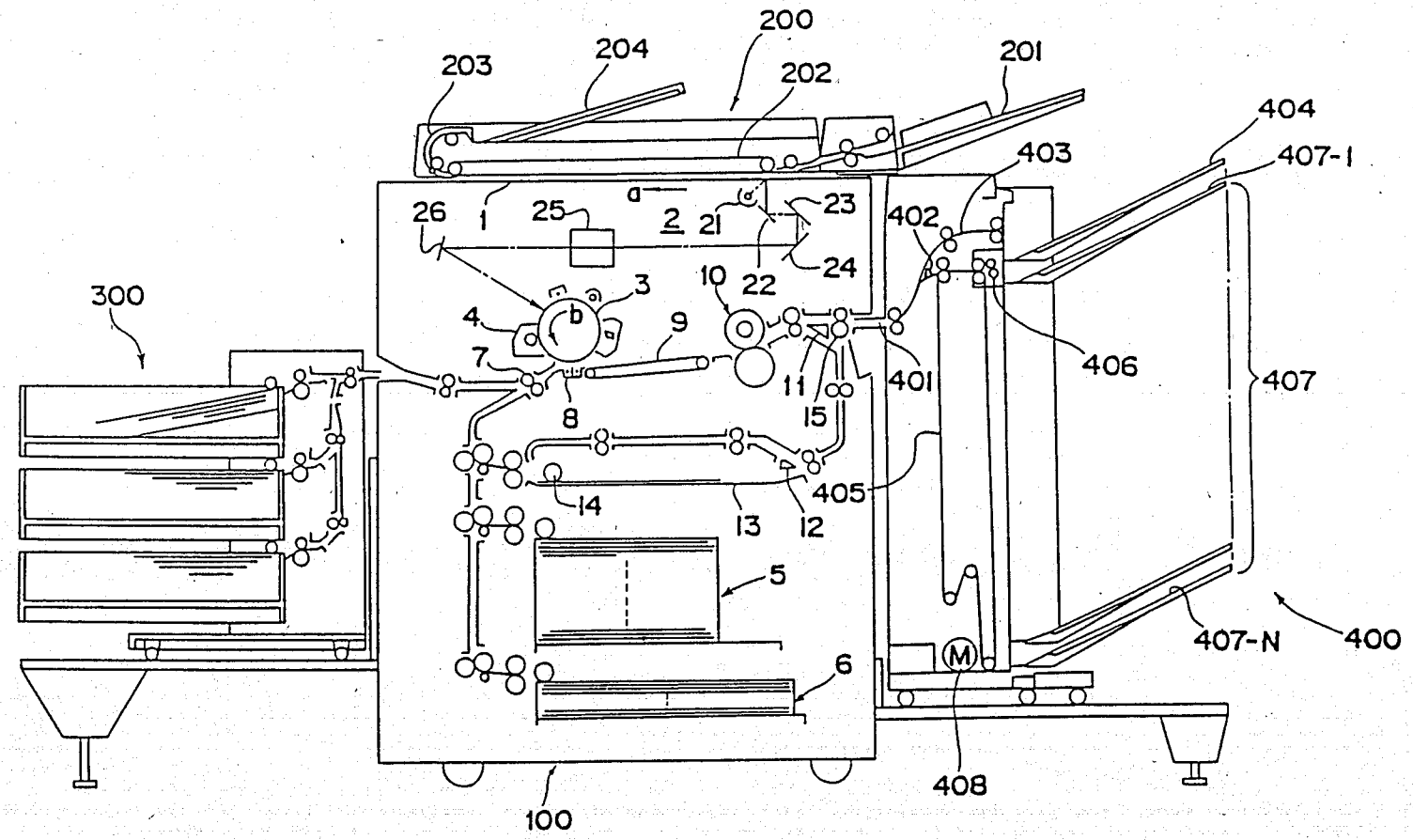
FIG. 1 is a schematic cross sectional views of a copying machine according to one preferred embodiment of the present invention.

FIG. 1 illustrates a system of a copying machine to which the present invention is applicable. In FIG. 1, the copying machine 100 is provided with an automatic document feeder (hereinafter, it is called "ADF") at the upper section, a three-stages paper stacker 300 on the left side section, and a sorter 400 on the right side section. The system of the copying machine is well-known except an operation panel 30 shown in FIG. 2 and a control device shown in FIG. 6, so that the system will be briefly described below, with accompanying an explanation of its operation as well. An optical system 2 of the copying machine 100 operates as follows. An exposure lamp 21 and a movable mirror 22 move together in the direction of an arrow mark "a" as well as a light emitted from the exposure lamp 21 is applied to an original image on an original glass plate 1 for scanning , whereby, through movable mirrors 23, 24, a lens 25 and a fixed mirror 26, an electrostatic latent image is formed on a photoreceptor 3 by exposing the photoreceptor 3 which rotates in the direction of an arrow mark "b". Then, this latent image is developed with toners by a developing device 4. After development of the latent image, the developed image is transferred by a transfer charger onto a copy paper which is synchronously fed with using a timing roller 7 from the paper stacker 300, or one of two paper feed trays which are removably arranged in the lower section of the copying machine 100. Then, it is so fixed that this paper is conveyed to a toner fixing device 10 by a conveyor belt 9.

The copying machine 100 has a function, as a normal function, of a simplex copy as well as a function of a duplex copy. In addition to the above, the copying machine 100 has a function of a composite copy as well. The duplex copy means to form an image on both side of the copy paper, and the composite copy means to form an image which is made by combination of a part of different originals, on the one side of one paper. For doing the duplex copy and the composite copy, the copying machine 100 is provided with an intermediate tray in the central section of the copying machine 100, in which the toner-fixed copy paper is accommodated temporarily. In the case of the duplex copy, the copy paper of which one side has been fixed is conveyed so as to make locus like the contrary of the capital "S" by deflected members 11, 12, so that the paper is accommodated upside down in the intermediate tray 13, i.e., an image surface of the copy paper is upward. In the case of the composite copy, the copy paper is accommodated in the intermediate tray 13 from the rear of the intermediate tray 13 (from the left side in the drawing) so as to make locus like the capital "J". In this case, the image surface of the copy paper is downward in the intermediate tray 13. When a new original is set on the original glass plate 1, the copy paper which is accommodated in the intermediate tray 13 is fed out by a paper feeding roller 14 into a transfer zone.

The above-mentioned ADF 200 basically feeds the original, of which a copied surface is downward, put on an original tray 201 in order from the upperest original on the tray 201, and the fed paper is conveyed up to a predetermined position on the original glass plate 1 by the conveyor belt 202, and then the ADF 200 sets the copy paper. After completion of exposure to the original by the above-mentioned optical system 2, the ADF 200 drive a conveyor belts 202, and the exposed original is discharged to an original receiving tray 204 through a discharging path 203. At the same time, the ADF 200 feeds a new original and the new original is set on the original glass plate 1.

The above-mentioned sorter 400 receives the fixed copy paper through inlet opening 401, which is discharged by a discharging roller 15 provided for the copying machine 100. The sorter has three sorting modes which are a non-sorting mode, a sorting mode, and a grouping mode. That is, in case of the non-sorting mode, the copy paper is fed to a non-sort bin 404 by a deflected member 402 through a non-sort path 403. In case of the sorting mode or the grouping mode, the copy paper is fed to a path comprised with a belt 405 by the deflected member 402, and then the copy paper is discharged from a discharging port 406 to any bin 407-N of multiple bins 407 for sorting. As the multiple bins 407 is fixed at a body of the sorter 400, the discharging port 406 is shifted stepwise by a motor 408, to a position corresponding to each bin 407-N. Furthermore, it is so designed that the discharging port 406 goes up to the top bin 407-1 from the last bin by motor driving when one cycle of sorting is completed.

Figure 2:
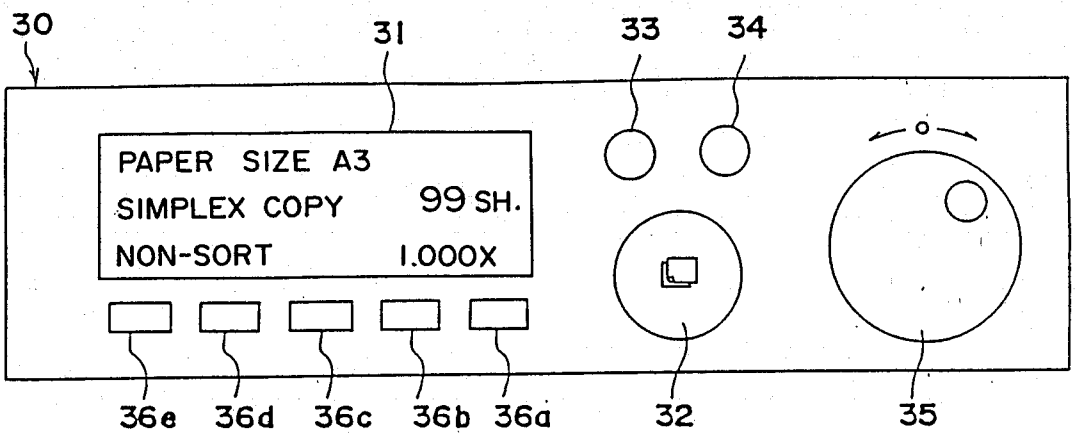
FIG. 2 is a plan view of an operation panel which is arranged on the copying machine shown in FIG. 1.

In FIG. 2, the operation panel 30 is provided with an indication window 31 for indicating respective operation mode which is set now, a copy start key button 32 for starting a copy operation, copy stop key button 33 for interrupting the copy operation and/or resetting a copy quantity which is set now to the quantity "1", a reset key button 34 for returning respective operation modes which is set now to an initial state, a rotary encoder (hereinafter, it is called an encoder) 35 for setting respective operation modes by operating the encoder which is rotatable to the both directions, and select keys 36a–36e for selecting the operation mode to be set by the encoder 35, therein 36b, 36c, 36d, and 36e designate a copy quantity key, a magnification key, a paper size key, copy mode key, and a sorter key, respectively.

Figure 3:
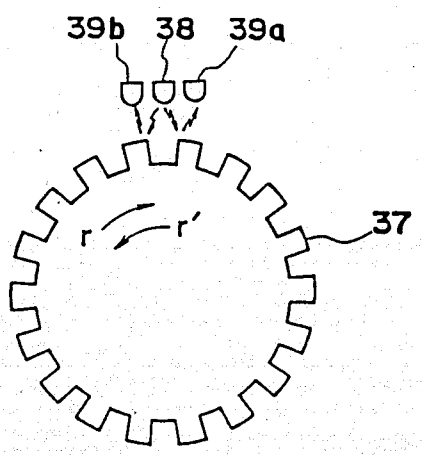
FIG. 3 is an explanatory drawing for explaining a structure of a rotary encoder.

The above-mentioned encoder 35, as shown in FIG. 3, comprises a gear 37 having a plurality of notches corresponding to a quantity of the predetermined pulse, a light emitting element 38 such as a LED or the like, and two light receiving elements 39a, 39b such as a phototransistor or the like, which receives the light emitted from the light emitting element 38, which is reflected at the gear 37. A projection of the gear 37 is ground like a mirror, so that the light from the light emitting element 38 is reflected to the direction of the light receiving elements 39a, 39b. Moreover, a recession of the gear 37 is treated so as not to reflect the light. Thereby, the two light receiving elements 39a, 39b output a pulse signal of a phase "A" and a phase "B", respectively when the gear 37 rotates to respective directions, i.e., direction of an arrow mark "r'".

Figure 4:
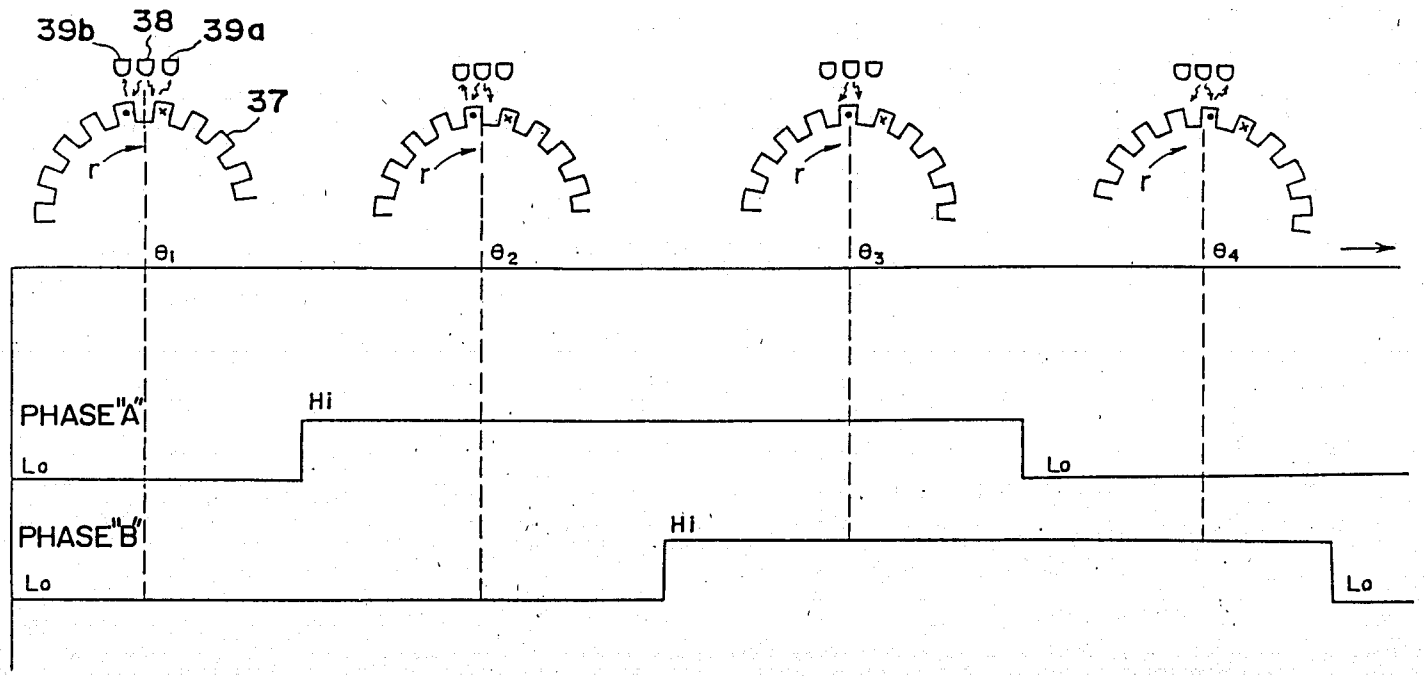
FIG. 4 is an explanatory drawing for explaining a relation between a rotating angle of the rotary encoder and a signal outputted by the rotary encoder.

In FIG. 4, an axis of abscissa shows a rotated angle of the gear 37 at the time when the encoder 35 is rotated in the direction of the arrow mark "r". The angle "$\theta_1$" on the axis corresponds to the position at which the recession between the projection marked with a dot and the projection marked with "x" in the gear 37 confronts the light emitting elements 38. The angle "$\theta_3$" corresponds to the position at which the projection marked with the dot confronts the light emitting element 38. The angles "$\theta_2$" and "$\theta_4$" corresponds to the position at which a boundary between the projection and the recession confronts the light emitting element 38. On the other hand, an axis of ordinates shows a signal level of an inversion output signal outputted by the light receiving elements 39a, 39b, therein the phase "A" is the inversion output signal from one light receiving element 39a, and the phase "B" is the inversion output signal from the other light receiving element 39b. Assuming that the encoder 35 is rotated by an operator, whereby, the gear 37 rotates in the direction of the arrow mark "r" from a certain position to the position of the angle "$\theta_1$", and then the two light receiving elements 39a and 39b receive, respectively, the lights reflected from the projection marked with the dot and the projection marked with "x". And both elements 39a, 39b output a low level signal Lo as the inversion signal. When the encoder 35 is rotated further to the same direction, the projection marked with "x" of the gear 37 becomes far away from the light emitting element 38, then one of the light receiving elements 39a can not receive the reflected light of the light emitting element 38. Consequently, the light receiving element 39a outputs a high level signal Hi as the inversion signal of the phase "A", and at the position of the angle "$\theta_2$", the signal level of the phase "A" and the phase "B" becomes high and low, respectively. When the projection marked with the dot is close to the light emitting element 39 as well as is far away from the other 39b of the light receiving elements after passing the position of the angle "$\theta_2$", the other 39b of the light receiving elements can not receive the reflected light of the light emitting element 38. Consequently, the light receiving element 39b outputs a high level signal Hi as the inversion signal of the phase "B". At the position of the angle "$\theta_3$", both signals of the phases "A", "B" become high. When the projection marked with the dot is far away from the light emitting element 38 as well as is close to one 39a of the light receiving elements after a further rotation of the gear 37 from the position of the angle "$\theta_3$", the light receiving element 39a receives the reflected light of the light emitting element 38, again. Consequently, the light receiving element 39a outputs the low level signal as the inversion signal of the phase "A". And at the position of the angle "$\theta_4$", the signal level of the phase "A" becomes low and the signal level of the phase "B" becomes high. When a succeeding projection of the projection marked with the dot is close to both elements 38, 39b of the light emitting element and the other light receiving element after further rotation of the gear 37 from the position of the angle "$\theta_4$", the other 39b of the light receiving elements receives the reflected light of the light emitting element 38. Consequently, the light receiving element 39b outputs the low level signal as the inversion signal of the phase "B". That is, both signals of the phase "A" and the phase "B" become low, as similar to the case of the angle "$\theta_1$" which is mentioned above. As explained above, two output signals having a different phase can be obtained from the two light receiving elements 39a, 39b of the encoder 35. On the contrary to the above, when the gear 37 rotates in the direction of the arrow mark "r'", two output signals having a different phase can be obtained, as similar to the case at the time when the gear 37 rotates in the direction of the arrow mark "r".

The encoder 35 outputs, as explained above, two pulse signals having two phases "A", "B" corresponding to the rotated angle and the rotating direction of the encoder 35. It means that the rotated angle can be known by a number of the pulse, as well as, the rotating direction of the encoder 35 is the direction of the arrow mark "r" if the pulse of the phase "A" is a leading edge at which the signal of the phase "A" becomes "Hi" state from "Lo" state when the signal of the phase "B" is low, and the rotating direction of the encoder 35 is the direction of the arrow mark "r'" if the pulse of the phase "A" is a trailing edge at which the signal of the phase "A" becomes "Lo" state from "Hi" state when the signal of the phase "B" is low.

Figure 5:
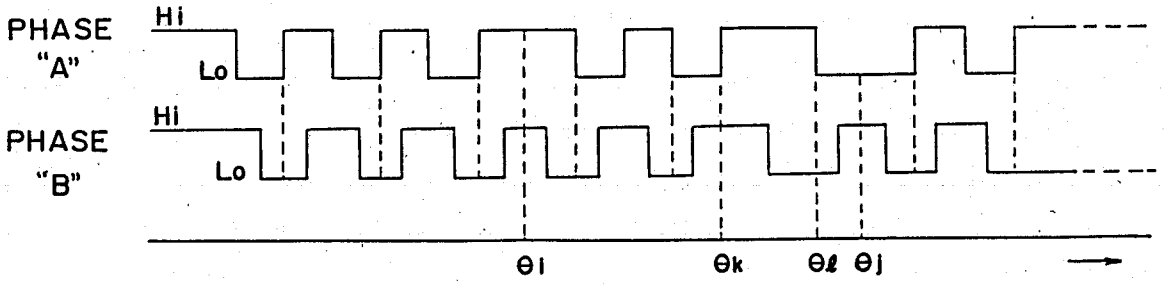
FIG. 5 is a diagram of one example of the signal from the rotary encoder.

FIG. 5 shows an one example of the output signal from the encoder 35. In the drawing, when the signal level of the phase "B" is low, the pulse signal of the phase "A" is always the leading edge up to the angle "$\theta$i ". Therefore, it means that the encoder 35 has been rotated in the direction of the arrow mark "r" shown in FIG. 3. And at the range from the angle "$\theta$i " to the angle "$\theta$j ", the pulse signal of the phase "A" is the trailing edge when the signal level of the phase "B" is low. It means that the encoder 35 has been rotated in the direction of the arrow mark "r'" shown in FIG. 3. At the further range from the angle "$\theta$j" the pulse signal of the phase "A" is the trailing edge when the signal level of the phase "B" is low. Therefore, it means that the encoder 35 has been rotated in the direction of the arrow mark "r", again. In addition to the above, at the range from the angle "$\theta$k " to the angle "$\theta$l", a pulse width becomes wide in the drawing. It means that the encoder 35 has been rotated gradually.

Figure 6:
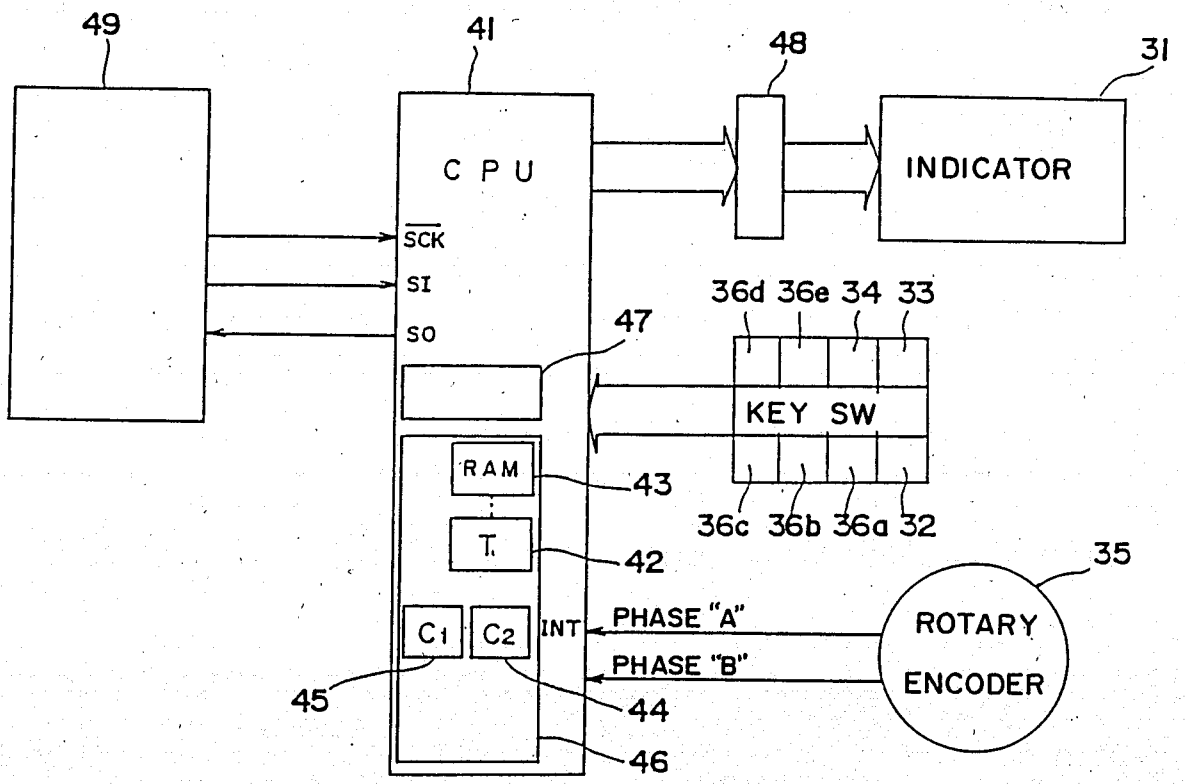
FIG. 6 is an explanatory drawing for explaining a control device of the copying machine.

Referring now to FIG. 6, there is shown an input-output structure of a microprocessor (hereinafter, it is called "CPU") by which mode setting of the copy operation and an input-output control from the operation panel 30 can be performed. The CPU 41 is provided with a timer 42 of the width of the encoder pulse outputted from the encoder 35, a memory 43 of the pulse width for memorizing a value of the timer 42, pulse interruption handling means for handling an interruption of the encoder pulse, having a down-counter 44 for counting a number of the leading edge of the encoder pulse and a up-counter 45 for counting a number of the trailing edge of the encoder pulse, and dividing means for dividing the encoder pulse. Furthermore, the CPU 41 is connected with the indication window 31 through an interfacing controller 48, several key switches 32, 33, 34, 6a or 36e associated with several keys, arranged on the operation panel 30, the encoder 35, and a signal line for a serial communication to another CPU 49. The CPU 41 outputs digital signals, corresponding to data which are indicated at the indication window 31, to the controller 48, then the controller 48 controls the indication in the indication window 31 for a displayed indication, depending on data from the CPU 41. The ON/-OFF states of the respective key switches 32, 33, 34, 36a–36e are inputted into the CPU 41 through these key switches. By the encoder 35, two pulse signals corresponding to the phase "A" and the phase "B" are inputted into the CPU 41. One of two signals (in this embodiment, it is the signal of the phase "A"), at least, is led to an interruption terminal of the CPU 41, for enabling to perform an interrupt operation to the CPU 41 by means of the leading edge or the trailing edge of the encoder pulse. It is, whereby, so designed that the interruption to the CPU 41 is performed by pulse interruption handling means. The serial signal line, as mentioned above, is engaged with another CPU 49 at one end of the line, by which the copy operation of the copying machine 100 is controlled, whereby the operation modes and any other data are exchanged between two CPU 41 and 49 through a communication processing.

In the system of the copying machine 100 having the structure described above, the copy operation depending on the selected operation mode will be done as follows. The operator selects the operation mode with the selecting key 36a–36e, which the operator would like to change among the operation modes which are displayed at the indication window 31. After that, the operator sets the desirable mode with rotating the encoder 35, and then depressing the start button 32 for copying, so that the copying machine 100 starts copying with the set mode.

Figure 7:
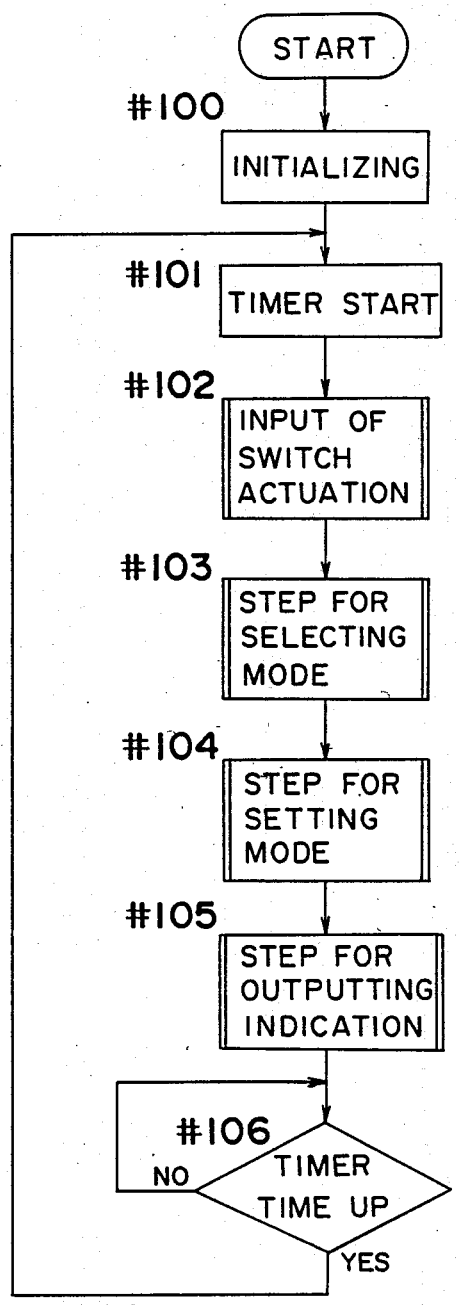
FIG. 7 is a flow chart of a main routine for explaining a control which comprises several subroutines to be broken-down functionally as listed below.
Figure 19:
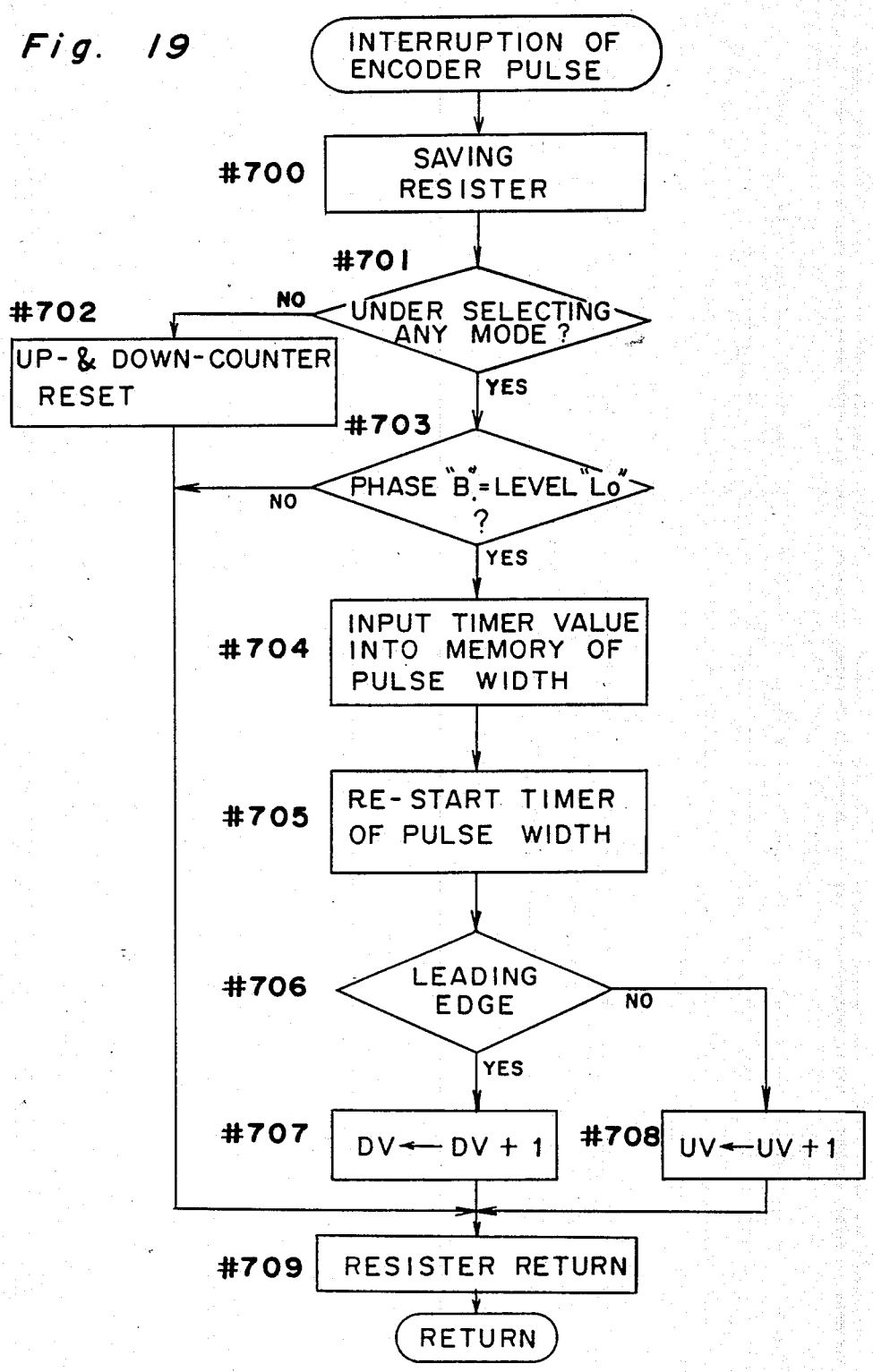
FIG. 19 is a flow chart showing an interruption handling routine of an encoder pulse.
Figure 20:
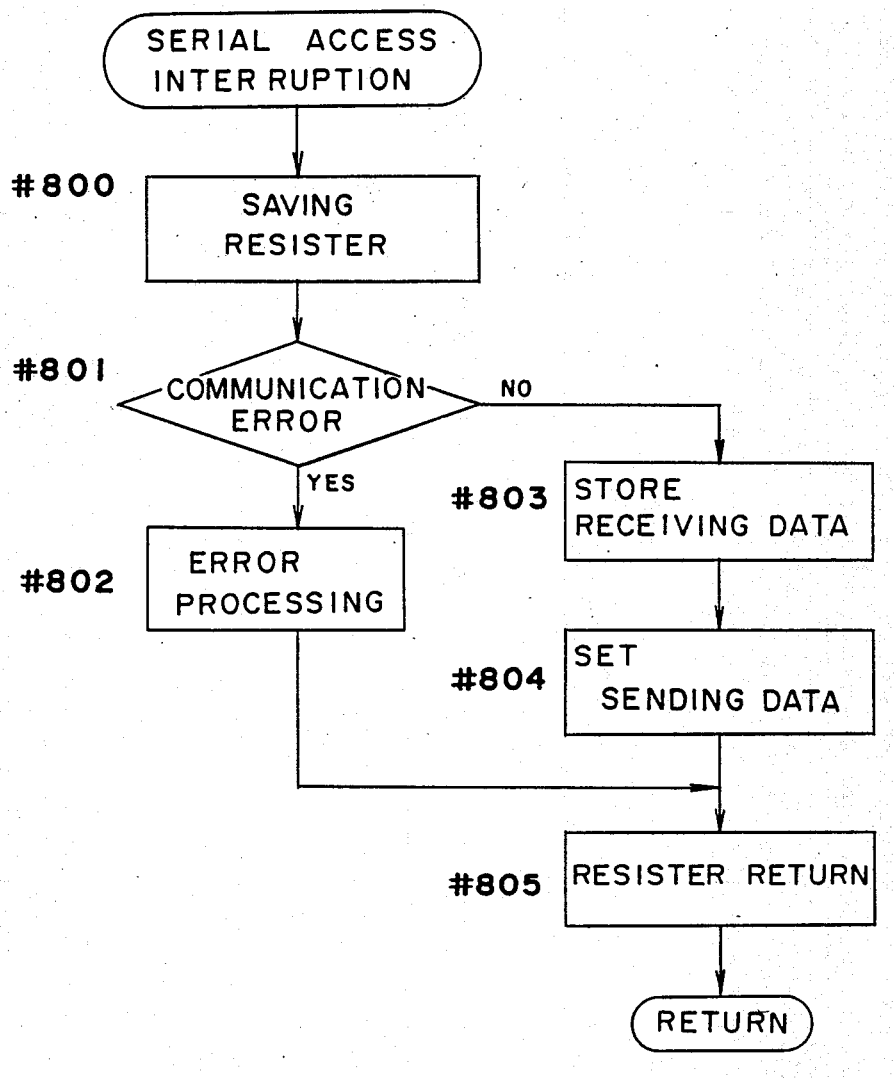
FIG. 20 is a flow chart showing an interruption handling routine of a serial access.

Referring now to the drawings of FIG. 7 through FIG. 20, the control operation of the CPU 41 is explained below. FIG. 7 shows summary of the control procedure by the CPU 41. In the drawing, at first, initialization necessary for controlling the CPU 41 is carried out at step #100. Then, a routine timer starts at step #101. This timer is a timer for determine an operating time of the main routine as shown in FIG. 7, whereby it is ensured that the processing of the main routine is always carried out with a certain period. At step #102, actuated states (ON/OFF) of respective key switches 32, 33, 34, 36a–36e at the operation panel 30 are inputted into the CPU 41, and the input date are stored in the memory. At step #103, the operation mode to be set by the encoder 35 is selected. At step #104, the operation mode selected at step #103 is set by the CPU 41 depending on the input data from the encoder 35. At step #105, outputting of the set mode of the copy operation is carried out to the operation panel 30. At last, the CPU 41 is scanning until the routine timer is time-up at step #106, and then the program returns to step #100 by time-up of the timer. However, during execution of the processing at each steps, the interruption ordered by the encoder 35 or the CPU 49 is enabled. In such a case, the interrupting processing is carried out depending on an interruption subroutine as shown in FIG. 19 or FIG. 20.

Figure 8A:
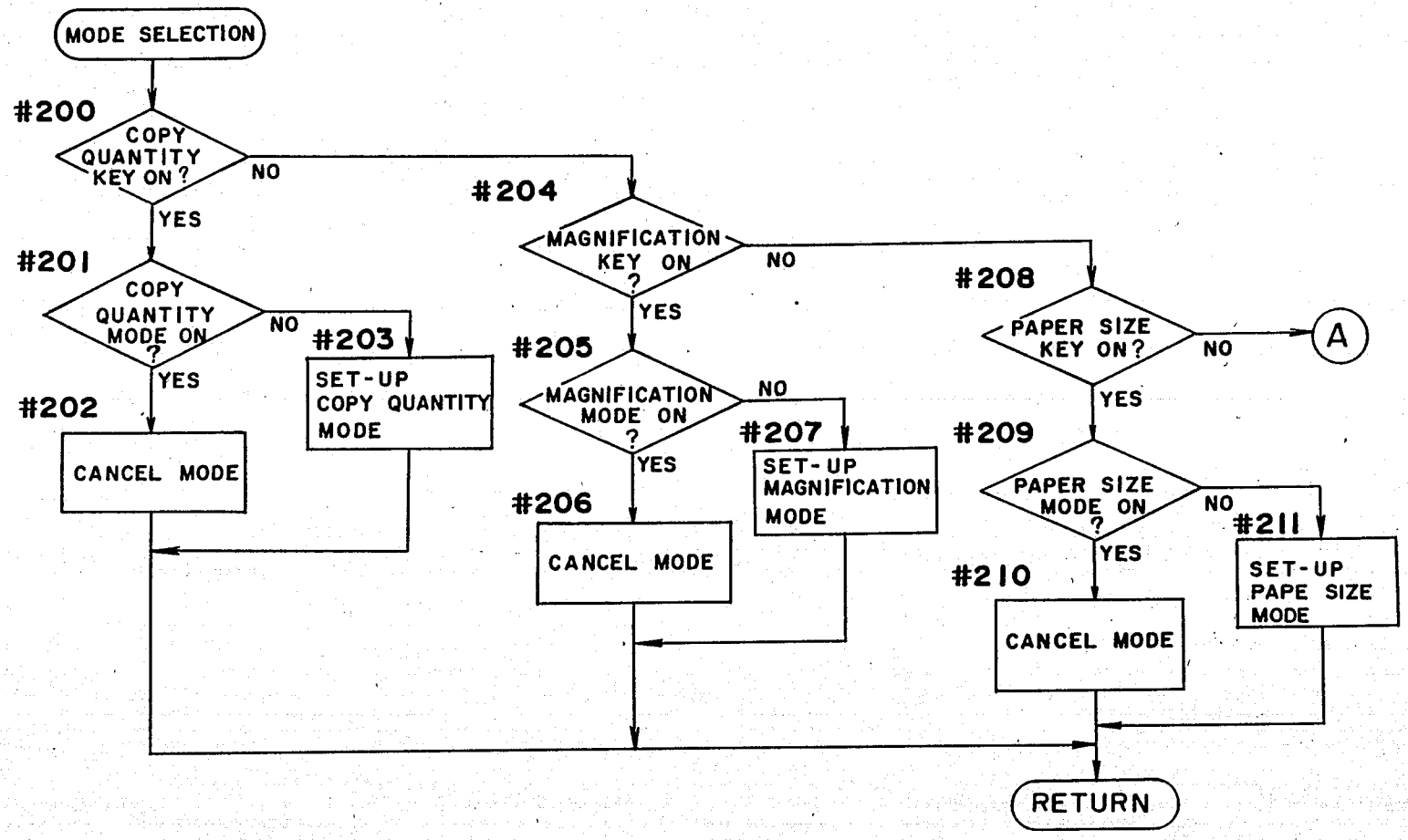
FIGS. 8A and 8B are flow charts of one subroutine which is divided to two portions, included in FIG. 7, showing an operation mode selection, respectively.
Figure 8B:
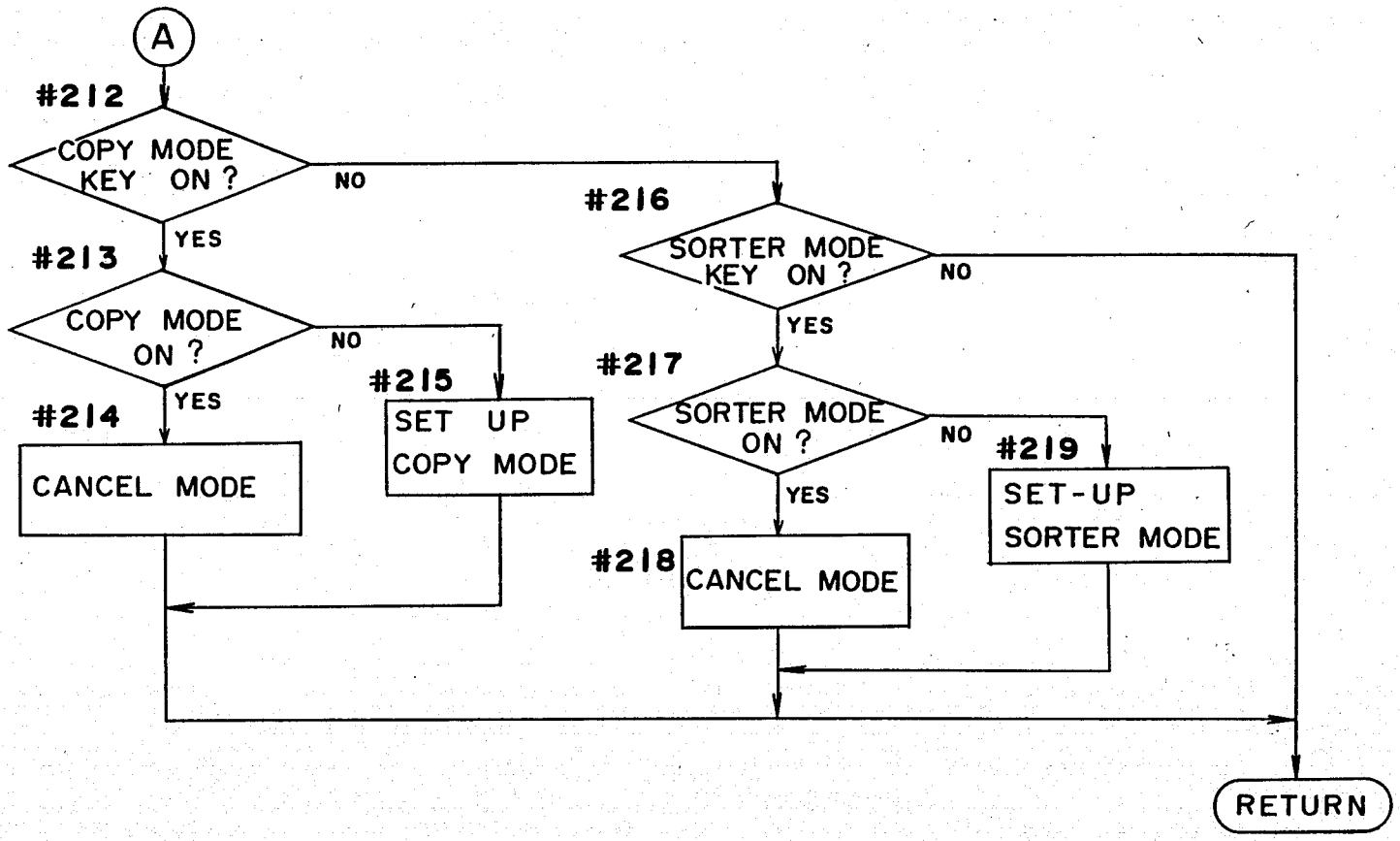

FIGS. 8A and 8B show a subroutine of the processing for selecting the operation mode, which is carried out at step #103 in the mainroutine shown in FIG. 7. At respective steps #200, #204, #208, #212 and #216, it is decided whether any one of the copy quantity key 36a, the magnification key 36b, the paper size key 36c, the copy mode key 36d, and the sorter key 36e is depressed or not, i.e., any one of respective key switches associated with the respective keys is actuated or not. The decision of "ON" at each step means to detect an ON-edge. The term ON-edge means the change of state of a key from the off state to the on state. When any one of keys is decided it is "ON", the program goes to the concerned step for selecting the operation mode to be set. The procedure of the processing for each mode is common. Therefore, the operation mode of the copy quantity, as one example, is described below. At first, when detecting ON-edge of the copy quantity key 36a at step #200, the program advances to step #201. At step #201, it is decided whether the copy quantity mode is now selected or not. When selecting this mode, it is canceled. When not selecting this mode, the copy quantity mode as an operation mode to be set is selected and the program returns.

Figure 9:
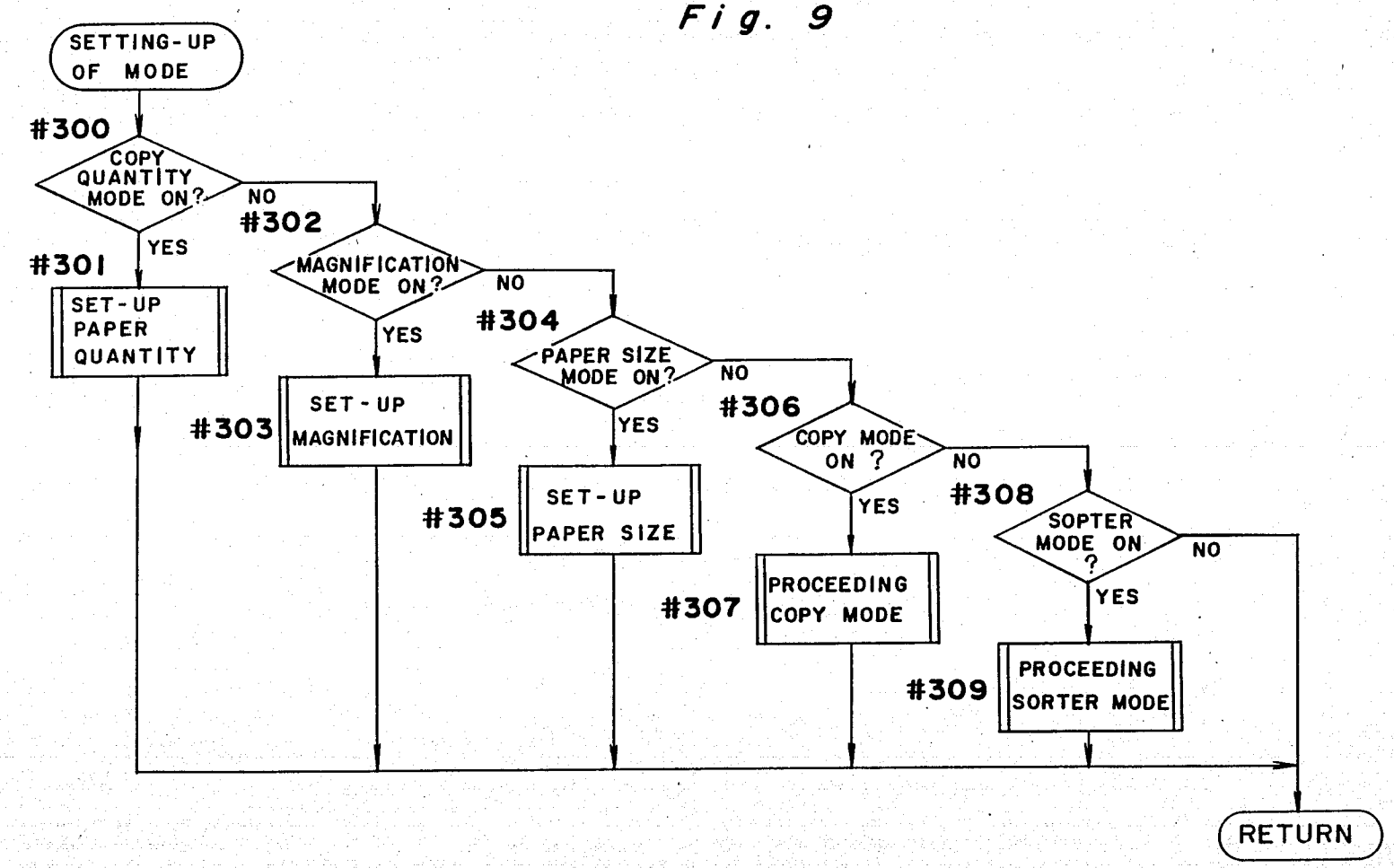
FIG. 9 is a flow chart of a subroutine included in FIG. 7, showing operation mode setting, which includes five subroutine flow charts as listed below.

FIG. 9 shows a subroutine of the processing for setting the operation mode selected at step #103 in FIG. 7, which is carried out at step #104 in the mainroutine shown in FIG. 7, depending on the signal from the encoder. At respective steps #300, #302, #304, #306 and #308, it is decided whether the operation mode to be set is selected or not, respectively. When any one of the operation modes is not selected at respective steps described above, the program returns. When any one of the operation modes is selected at respective steps, the program advances to the concerned step, correspondingly. That is, at any step corresponding to steps #301, #303, #305, #307 and #309, the processing for setting the operation mode is carried out, respectively. After that, the program returns. The processing at steps #301, #303, #305, #307 and #309 is carried out with the respective subroutines shown in FIG. 10 through FIG. 14.

The detailed subroutines corresponding to the abovementioned subroutines are as follows.

Figure 10:
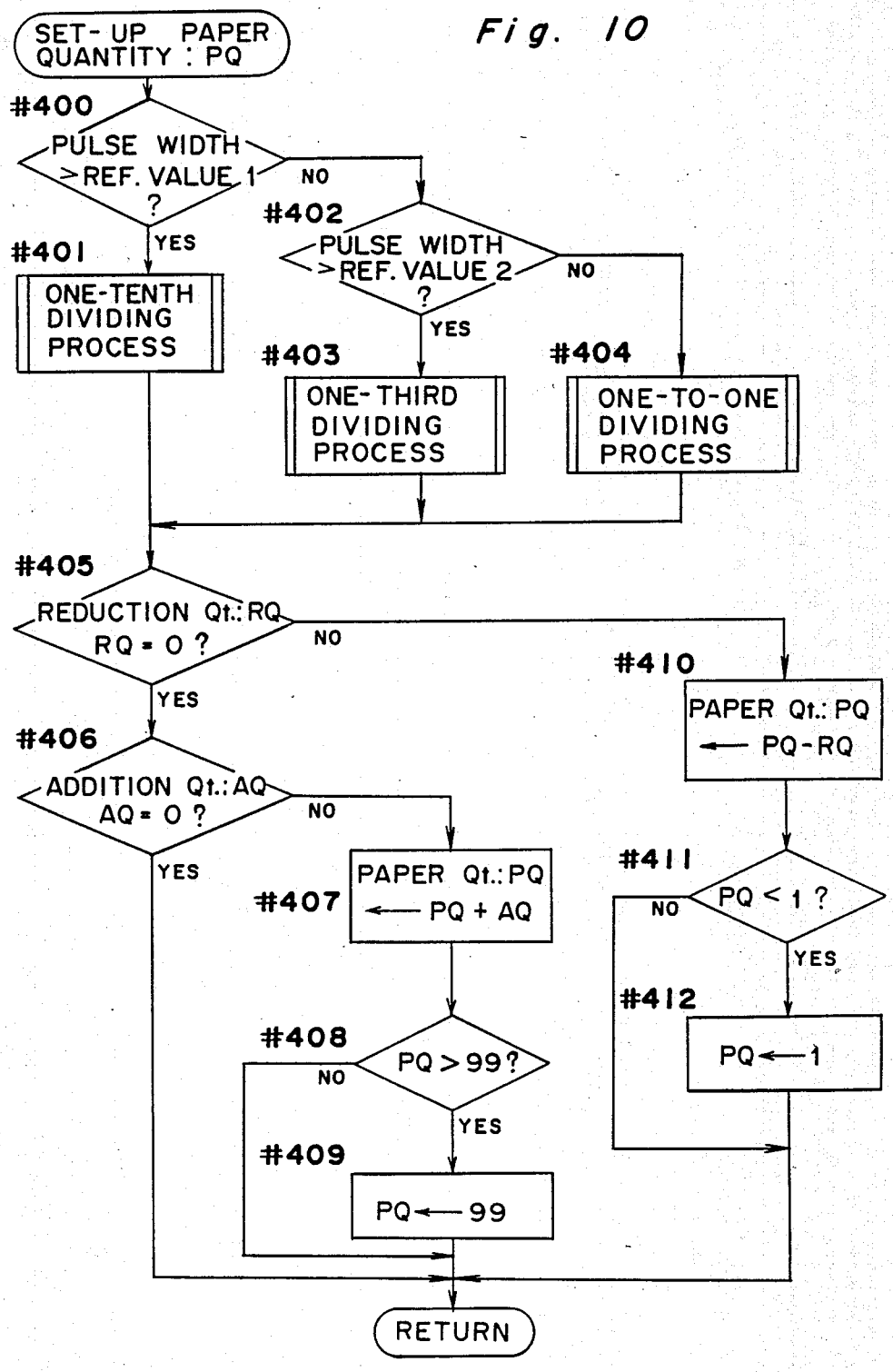
FIG. 10 is a flow chart of a subroutine included in FIG. 9, showing copy quantity setting.

FIG. 10 shows a subroutine of the processing for setting the copy quantity, which is carried out at set #301 in the subroutine shown in FIG. 9. At first, the pulse width memorized in the memory 43 of the pulse width is, respectively, compared with the reference value 1 at step #400 and the reference value 2 at step #401. In this memory 43, the pulse width of the encoder pulse measured by the timer 42 of the pulse width, which uses in the interruption handling routine of the encoder pulse shown in FIG. 19, i.e., the interruption interval, is stored. It means that the shorter the value of the pulse width becomes, the faster the rotating speed of the encoder 35 becomes. The abovementioned reference values 1 and 2 are to be a standard by which dividing of the encoder pulse is made for an easy adjustment of setting the operation mode. And also, the two values 1 and 2 are selected in order that the reference value 1 may be larger than the reference value 2. That is, the quantity which the operator is going to alter is estimated by the rotating speed of the encoder 35, whereby it is possible that a rough adjustment can be made easily if the speed is fast, for example, over 2 r.p.s., and a severe adjustment can be made easily if the speed is slow, for example, less than 1 r.p.s. When the pulse width is larger than the reference value 1, the program advances to step #401, and the one-tenth dividing process of the encoder pulse is carried out. If the pulse width is smaller that the reference value 1 at step #400. The program goes to step #402, and the comparison between the pulse width and the reference value 2 is carried out. When the pulse width is larger than the reference value 2 at step #402, the program advances to step #403, and the one-third dividing process of the encoder pulse is carried out. If the pulse width is smaller that the reference value 2 at step #402, i.e., the pulse width<the reference value 2<the reference value 1, the program goes to step #404, and the one-to-one dividing process of the encoder pulse is carried out. Each pulse dividing result at steps #401, #403 and #404 is fetched in a resistor for a reduction quantity RQ or an addition quantity AQ, correspondingly, and the program advances to step #405. The respective pulse dividing processes will be described in detail, later. At steps #405 and #406, the reduction quantity RQ and the addition quantity AQ are checked respectively. If both of the quantities RQ, AQ are "zero", then the program returns. If the reduction quantity RQ is not "zero" at step #405, then the program goes to step #410, and the following subtraction is performed; the present copy quantity—the reduction quantity, and the present copy quantity displaced by the result of subtraction at step #410. Then, the program advances to step #411, and it is checked at step #411 whether the copy quantity is less than "1". If the copy quantity is not less than "1", the program returns. If it is less than "1", then program advances to step #412, and the copy quantity is set to "1", and the program returns. On the other hand, if the addition quantity is not zero at step #406, the program advances to step #407. At step #407, the following addition is performed; the present copy quantity+the addition quantity, and the present copy quantity is displaced by the result of addition at step #407. Then, the program advances to step #408, and it is checked at step #408 whether the copy quantity is more than "99". If the copy quantity is not more than "99", then the program returns. If the copy quantity is more than "99", then the program advances to step #409, and the copy quantity is set to "99", and the program returns.

Figure 11:
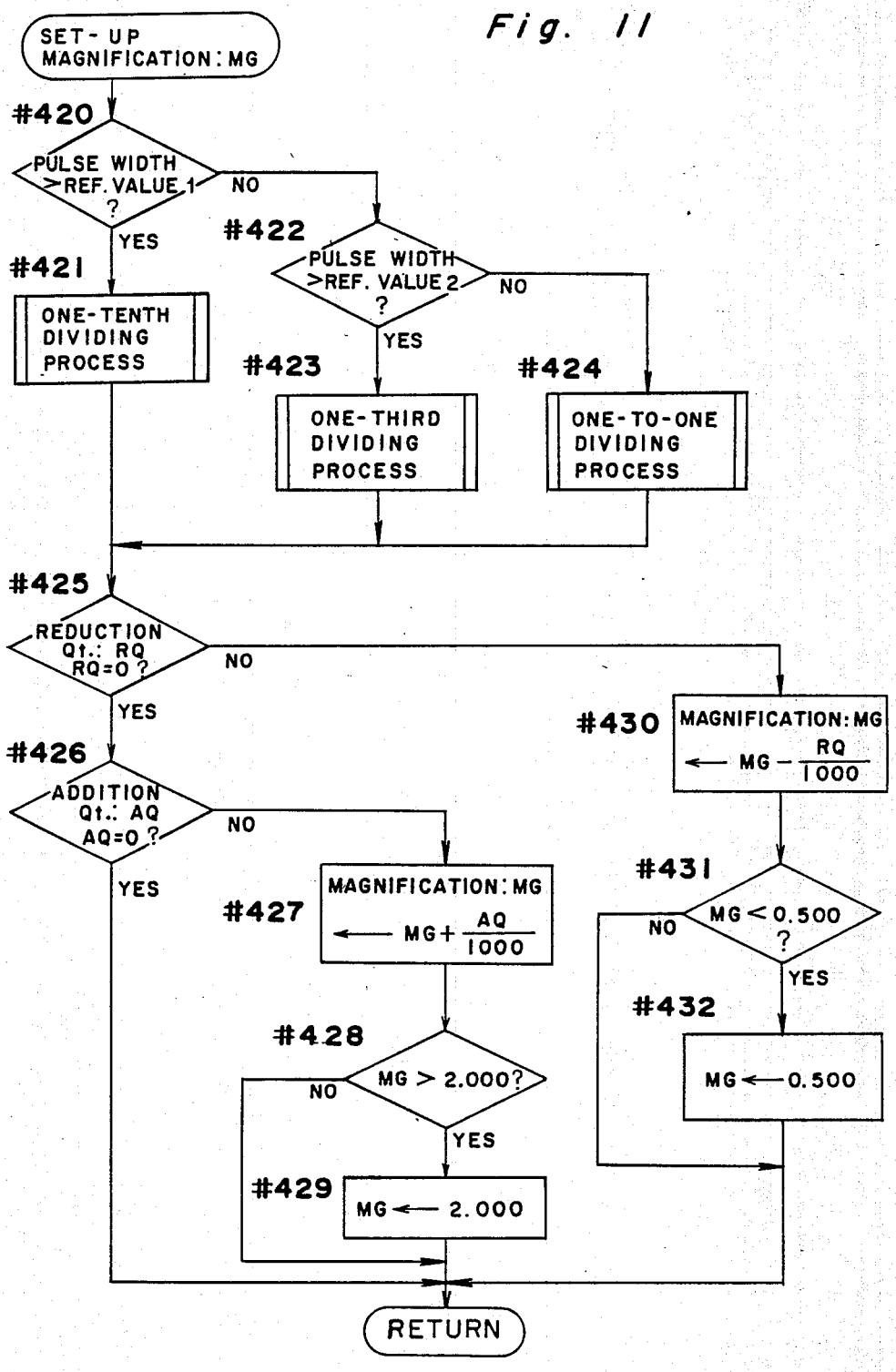
FIG. 11 is a flow chart of a subroutine included in FIG. 9, showing magnification setting.

FIG. 11 shows a subroutine of the processing for setting the magnification, which is carried out at step #303 in the subroutine shown in FIG. 9. Since a procedure for setting this mode is almost similar to the procedure for setting the above-mentioned copy quantity mode, the drawing of FIG. 11 is helpful for understanding its procedure without any detailed explanation, so that only different points from the above-mentioned procedure are described below. The different points from the processing for setting the copy quantity mode are;

(a) carrying out addition and subtraction of the magnification corresponding to the reduction quantity or the addition quantity with a unit of "1/1000", (b) providing the limitations of the magnification are 2.000 at the upper side and 0.500 at the lower side, respectively.

Figure 12:
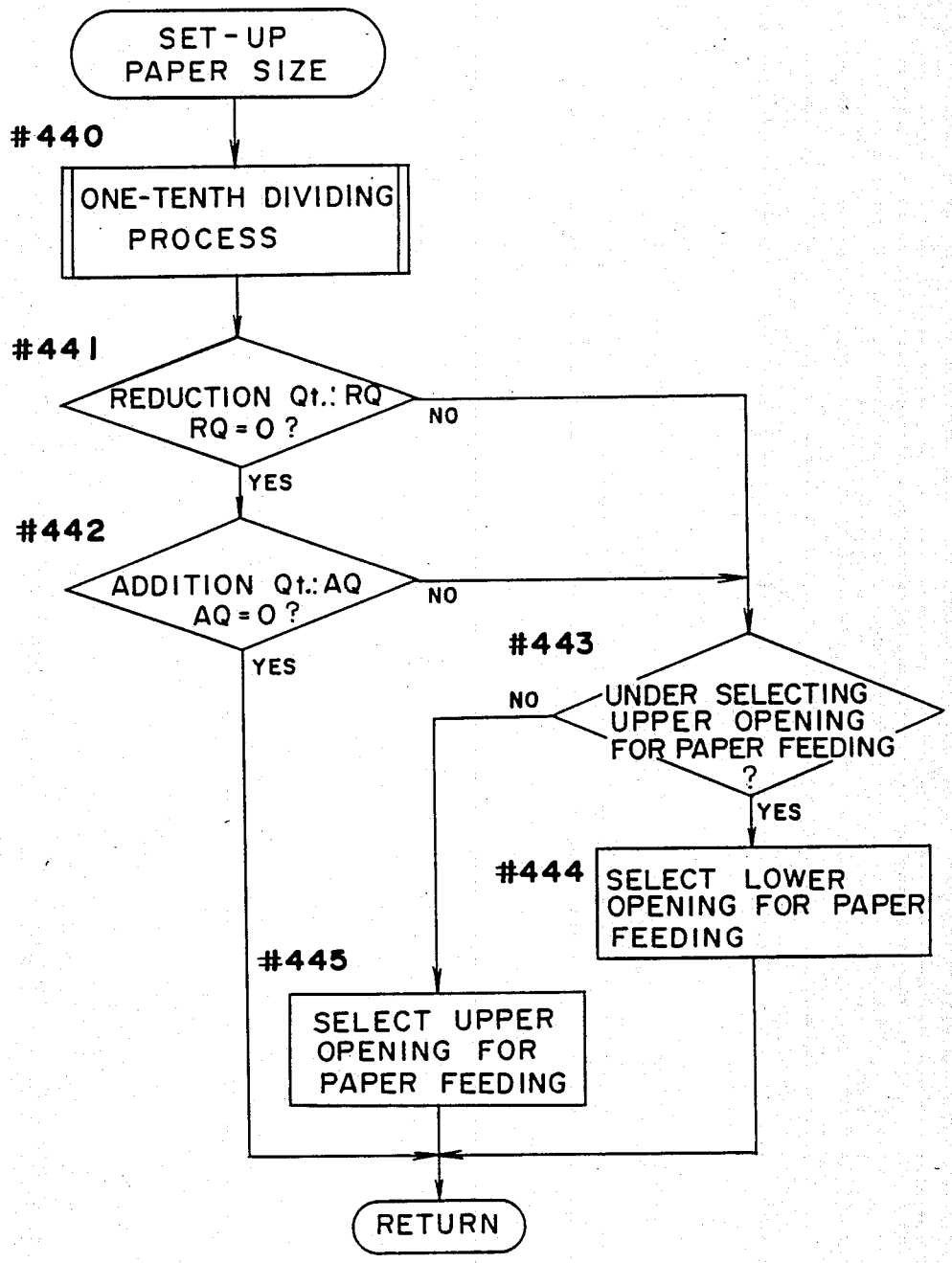
FIG. 12 is a flow chart of a subroutine included in FIG. 9, showing paper size setting.

FIG. 12 shows a subroutine of the processing for setting paper size, which is carried out at step #305 in the subroutine shown in FIG. 9. At first, the one-tenth dividing process of the encoder pulse is performed at step #440. At steps #441 and #442, respectively, the addition quantity and the reduction quantity are checked whether each quantity is zero. When it is checked at the respective steps that the respective quantities are "zero", the program returns. If it is checked that any one of two quantities is not "zero", the program goes to step #443. AT step #443, it is checked whether the upper opening for paper feeding is selected now or not. When selecting the upper opening, the program advances to step #444, and the lower opening for paper feeding is selected, and then the program return. At step #443, when not selecting the upper opening, the program goes to step #445, and the upper opening is selected, and then the program returns. The processing performed from step #443 to #445 is the processing of exchanging cassettes 5, 6 shown in FIG. 1, to be selected. It is, of course, better to be so designed that a copy paper is selected from the copy papers which are accommodated in the upper cassette, the middle cassette, or the lower cassette of the paper stacker 300.

Figure 13:
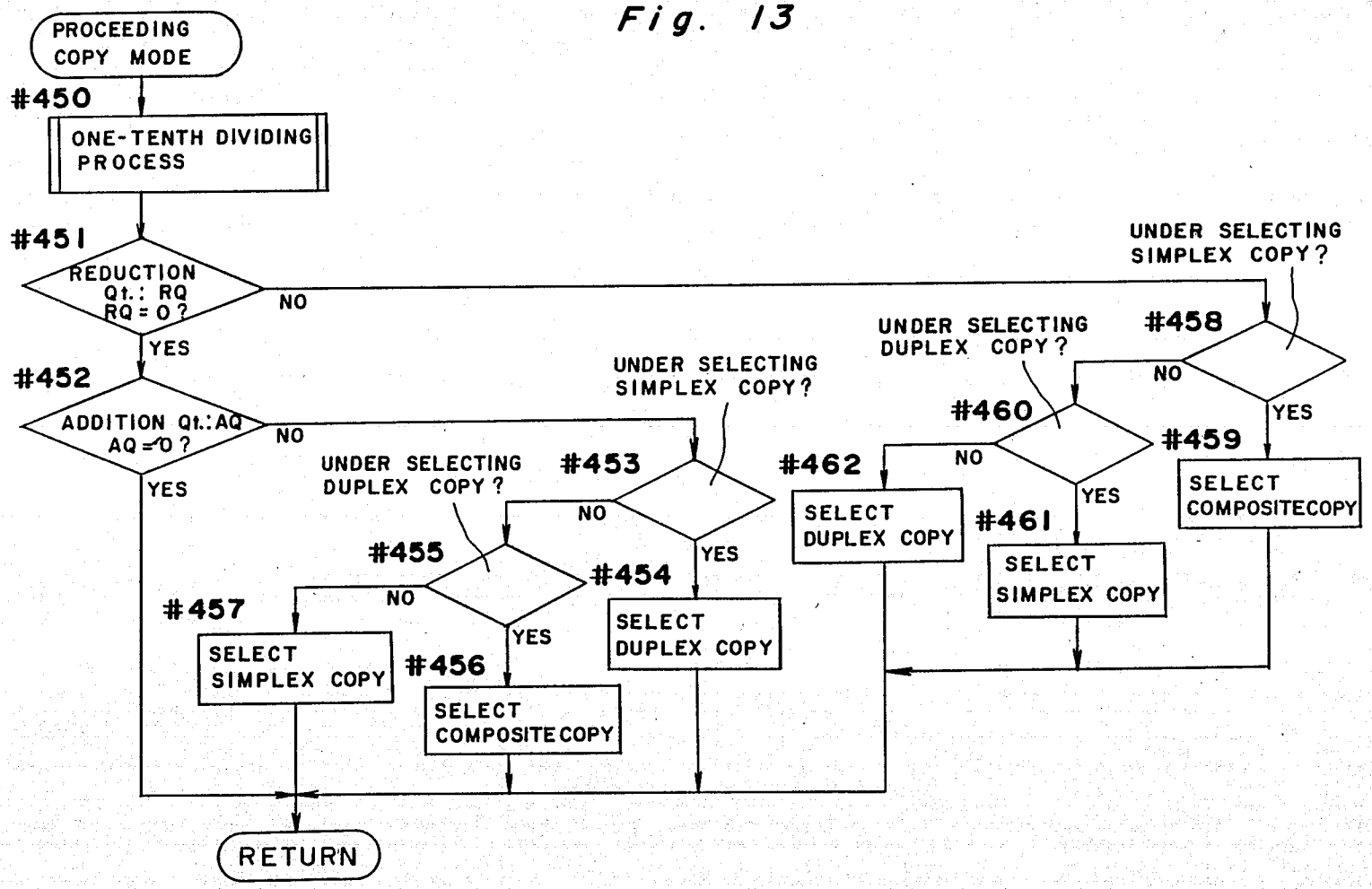
FIG. 13 is a flow chart of a subroutine included in FIG. 9, showing copy mode setting.
Figure 14:
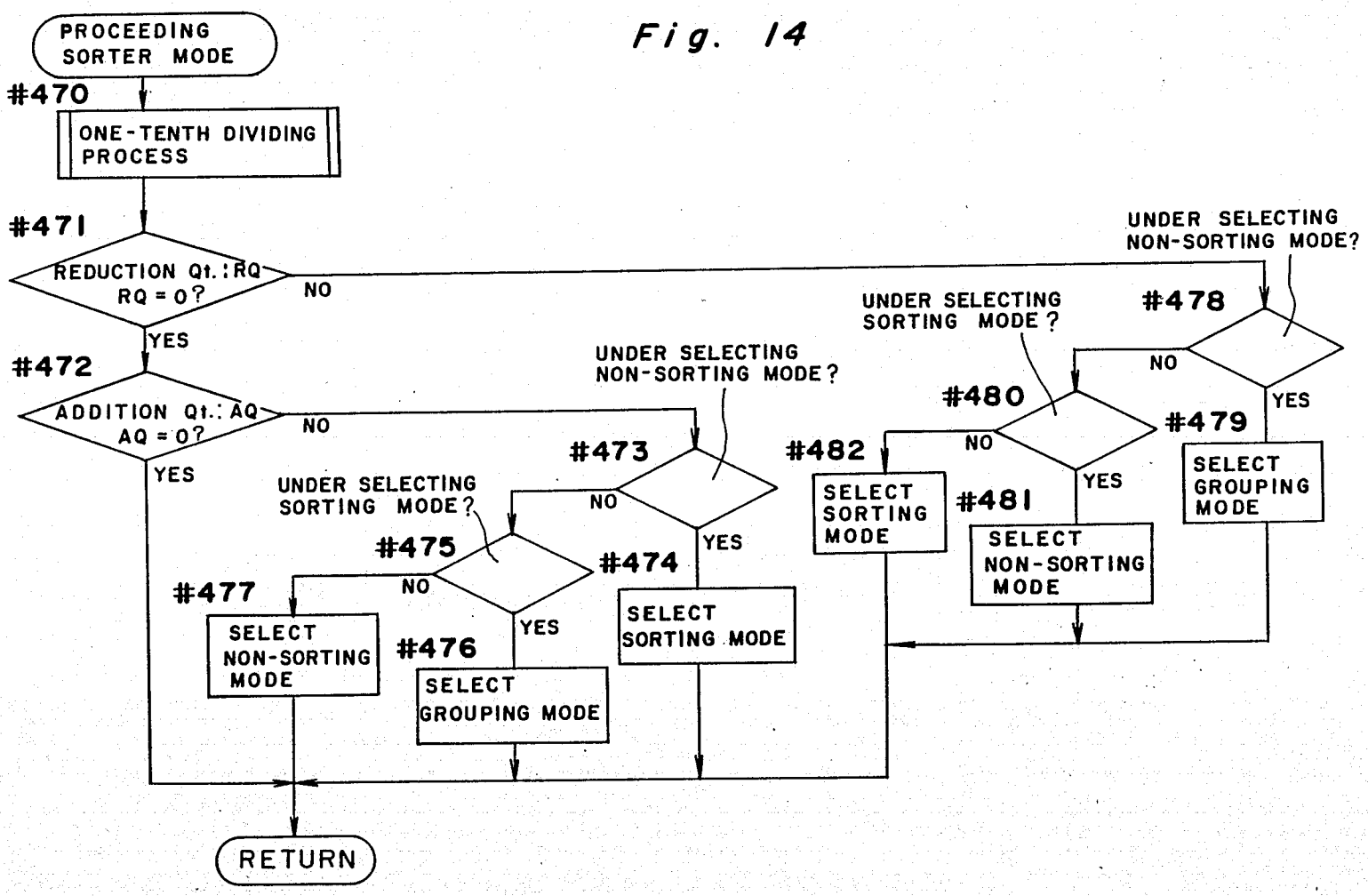
FIG. 14 is a flow chart of a subroutine included in FIG. 9, showing sorter mode setting.

FIG. 13 shows a subroutine of the processing for setting the copy mode, which is carried out at step #307 in the subroutine shown in FIG. 9, and FIG. 14 shows a subroutine of the processing for setting the sorter mode, which is carried out at step #309 in the subroutine shown in FIG. 9. The procedure of each subroutine is same except that respective operation modes to be set are just different, and also the procedure of the processing which is carried out at steps from the one-tenth dividing process of the encoder pulse to checking of the reduction quantity and the addition quantity is the same as the procedure of the corresponding processing for setting the paper size.

In the case of the processing for setting the copy mode shown in FIG. 13, when the reduction quantity is not "zero" at step #451, the program goes to step #458 and further step #460 in order, and it is checked at these steps, respectively, what copy mode is selected now, and one copy mode is selected at step #459, #461 or #462. That is, the processings carried out at respective steps from step #458 through #462 is as follows. The copy modes comprising "composite copy", "duplex copy", and "simplex copy" are switched over by turns ("composite copy"→"duplex copy"→"simplex copy"→"composite copy"→). After that, the program returns. On the other hand, if the reduction quantity is "zero" as well as quantity is not "zero", the program goes from step #451 to step #453 via step #452. And under the processing carried out at respective steps from step #453 through #457, the below-mentioned three copy modes are switched over, vice versa to the above, i.e., "simplex copy"→"duplex copy"→"composite copy"→"simplex copy"→. After the processing described above, the program returns.

In the case of the processing for setting sorter mode shown in FIG. 14, similarly, the following procedure is done. That is, when the reduction quantity is not "zero" at step #471, the sorter modes comprising "grouping", "sorting" and "non-sorting" are switched over by turns, i.e., "grouping"→"sorting"→"non-sorting" "grouping"→, under the processing carried out at respective steps from step #478 through step #482. On the other hand, if the reduction quantity is "zero" as well as the addition quantity is not "zero", the respective modes are switched over, vice versa to the above, i.e., "non-sorting"→"sorting"→"grouping"→"non-sorting"→, under the processing carried out at respective steps from step #473 through step #477. After execution of the processing described above, the program returns.

Figure 15:
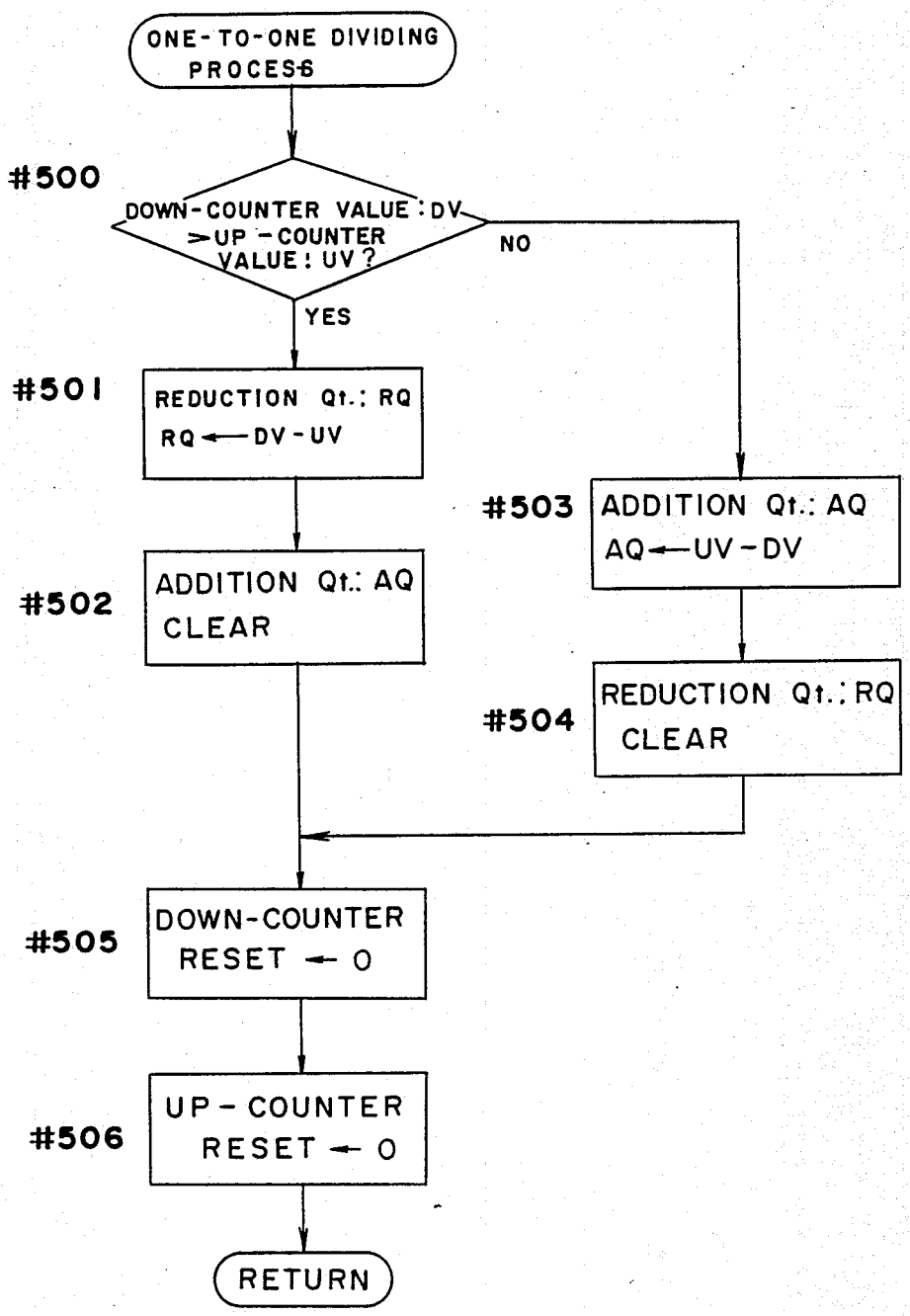
FIG. 15 is a flow chart of a subroutine included in FIG. 10, showing one-to-one dividing of a pulse signal.

FIG. 15 shows a subroutine of the processing for doing the one-to-one dividing of the encoder pulse, which is carried out at step #404 in the subroutine shown in FIG. 10 and at step #424 in the subroutine shown in FIG. 11. At first, a counting value DV of the down-counter 44 and a counting value UV of the up-counter 45 are compared at step #500. This down-counter 44 and the up-counter 45, correspondingly, count a number of the leading edge or the trailing edge of the encoder pulse corresponding to the rotating direction of the encoder 35 in the interruption handling routine of the encoder pulse shown in FIG. 19. When the counting value DV of the down-counter 44 is larger than the value UV of the up-counter 45, the program advances to step #501, and at step #501, arithmetic, DV−UV=- the present reduction quantity RQ, is carried out, and the addition quantity AQ is reset to "zero" at step #502, and then the program goes to step #505. If the counting value UV is larger than the value DV, the program goes to step #503, and at step #503, arithmetic, UV−DV=- the present addition quantity AQ, is carried. And the reduction quantity RQ is reset to "zero" at step #504, and the program advances to step #505. At steps #505 and #506, the down-counter 44 and the up-counter 45 are reset to "zero", respectively, and the program returns.

Figure 16:
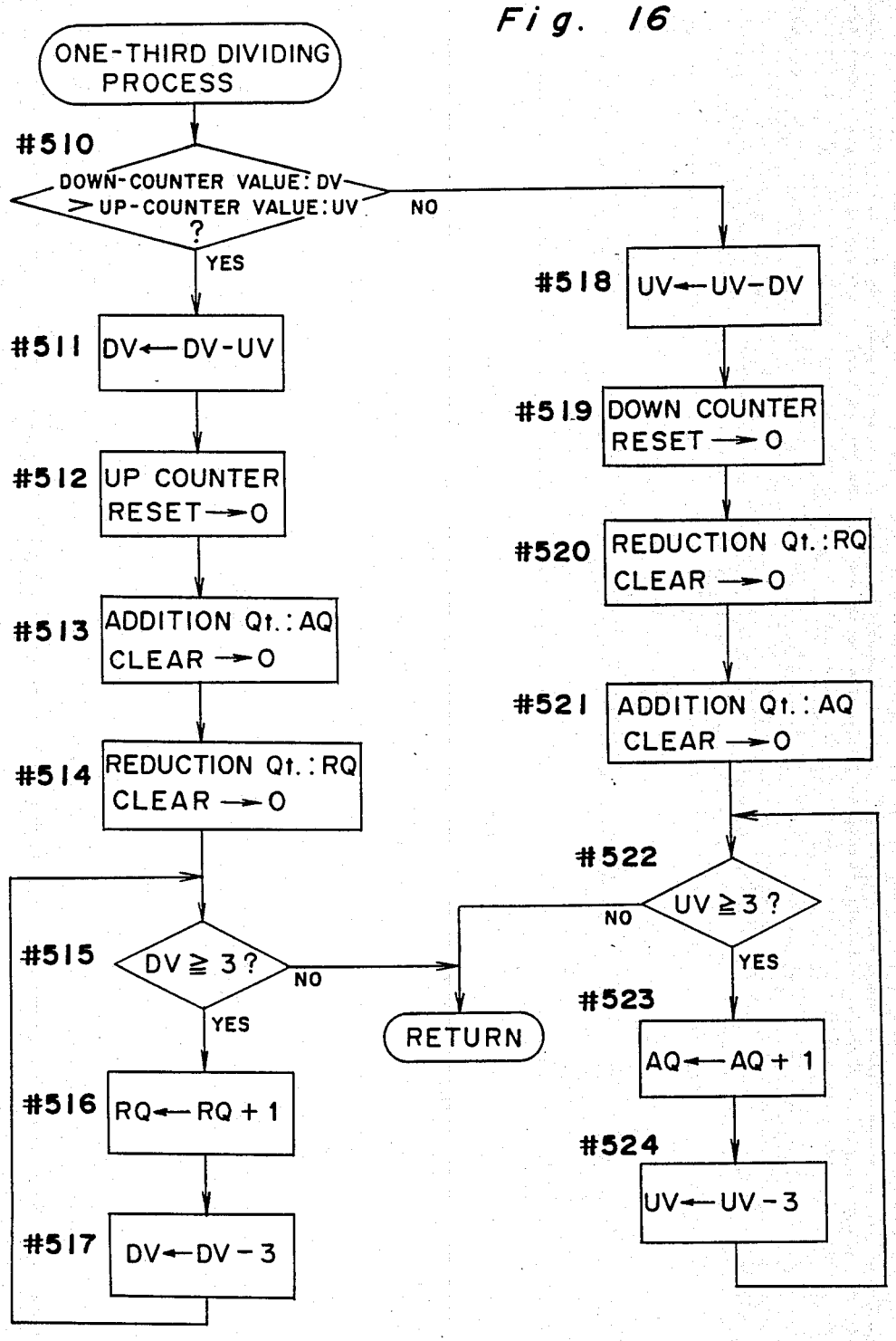
FIG. 16 is a flow chart of a subroutine included in FIG. 10, showing one-third dividing of the pulse signal.
Figure 17:
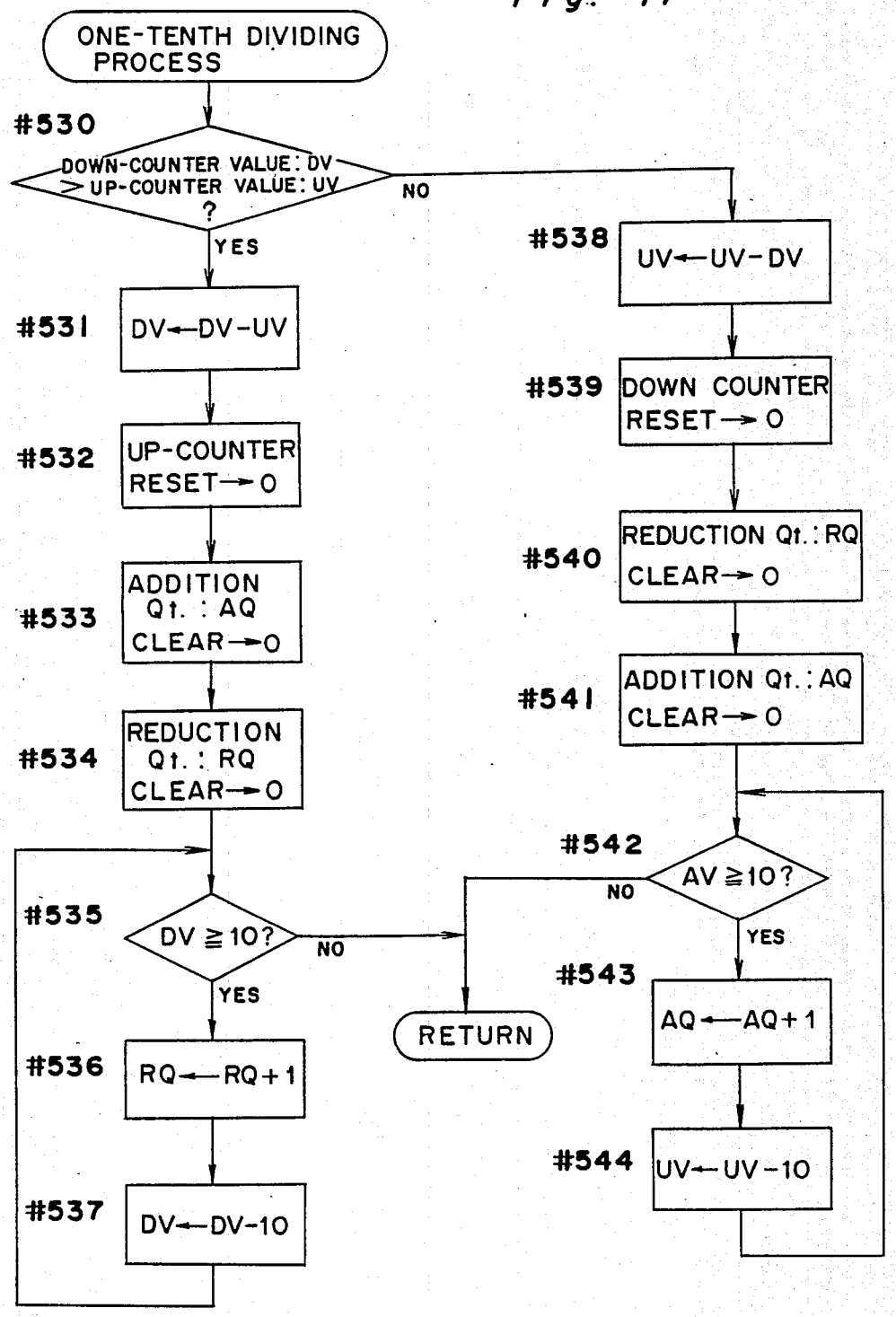
FIG. 17 is a flow chart of a subroutine included in FIG. 10, showing one-tenth dividing of the pulse signal.

FIGS. 16 and 17 show, respectively, a subroutine of the processing for dividing the encoder pulse. FIG. 16 shows the one-third dividing process of the encoder pulse, and FIG. 17 shows the one-tenth dividing process of the encoder pulse. The one-third dividing process is applied to step #401 in FIG. 10, step #421 in FIG. 11, step #440 in FIG. 12, step #450 in FIG. 13, and step #470 in FIG. 14. .

The respective subroutines are same except that the dividing unit is only different, i.e., the dividing unit is a unit of every three pulses for the one-third dividing process and the unit is a unit of every ten pulses for the one-tenth dividing process. Therefore, the one-third dividing process is only explained below.

In FIG. 16, the comparison between two values UV and DV of both up- and down-counter 45, 44 is carried out at step #510. When the value DV of the down-counter 44 is larger than the value UV of the up-counter 45, the program advances to step #511, and when UV≧DV at step #510, the program goes to step #518. At step #511, arithmetic, DV→UV →DV is carried out, and at steps #512, #513 and #514, the up-counter 45, the addition quantity AQ and the reduction quantity RQ are, respectively, reset to "zero", and the program advances to step #515. At steps #515, #516 and #517 the following processing is done. That is, the value DV of the down-counter 44 is divided by the unit of three pulse, and the results of the one-third dividing process is registered as the reduction quantity RQ, and the remainder of the result, produced by the one-third dividing process, is inputted to the down-counter 44. After execution of the above processing, the program returns. On the other hand, at step #518 through step #524, the value UV of the up-counter 45 is divided by the unit of three pulses, and the result of the one-third dividing process is registered as the addition quantity AQ, and the remainder of the result is inputted to the up-counter 45, similarly as the processing under step #511 through step #517. After execution of the above processing, the program returns.

Figure 18:
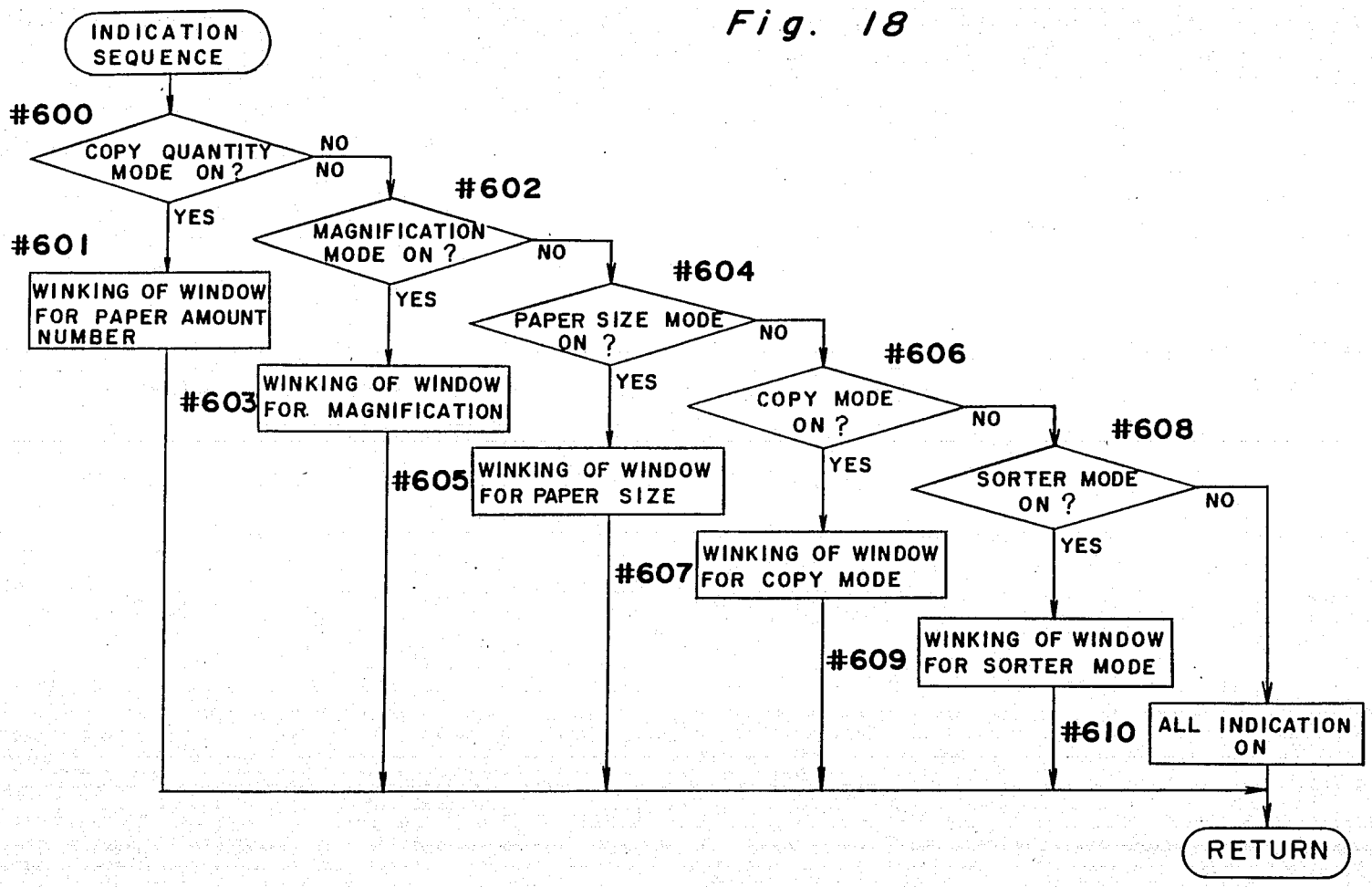
FIG. 18 is a flow chart of a subroutine included in FIG. 9, showing an output for an indication on the operation panel.

FIG. 18 shows a subroutine of the processing for outputting the indication, which is carried out at step #105 in the mainroutine shown in FIG. 7. At respective steps #600, #602, #604, #606 and #608, it is, respectively, decided which mode of the copy quantity, the magnification, the paper size, the copy mode, and the sorter mode is now under selecting. When any mode of the above is not under selecting at each step described above, all indications are turned on at step #610, and then the program returns. When any one mode of the above is now under selecting, the mode indication under selecting, respectively, flickers at respective steps #601, #603, #605, #607 and #609. After that, the program returns. Under the above processings, it is so designed that the visual confirmation is made easily by flickering of the indication of the mode set by the encoder 35.

FIG. 19 shows the interruption handling routine of the encoder pulse. The leading edge or the trailing edge of the phase "A" of the encoder pulse enables to interrupt. At step #700, the state before the interruption of the resistor which is used during the processing of the interruption is saved in a stack area. At step #701, it is decided whether or not any mode of the operation modes is under selecting. If not selecting any mode, the program advanced to step #702, and the up-counter 45 and the down-counter 44 is reset to "zero", and the program goes to step #709. If selecting one mode of the operation modes at step #701, the program goes to step #703, and at step #703, it is decided whether the signal of the phase "B" is the high level or the low level. If the signal level is high, the program goes to step #709. If the level is low, the program advances to step #704. At step #704, the timer value of the pulse width is inputted into the memory 43 of the pulse width, and at further step #705, the timer 420 of the pulse width is started again. This timer 42 is a timer to measure the interval of the pulse from the encoder 35. In other words, the timer value of this timer 42 is equivalent to the rotating speed of the encoder 35. At step #706, it is decided whether the interruption is made by the leading edge or the trailing edge of the pulse. If the interruption is made by the leading edge of the pulse, the program advances to step #707 for doing increment of the down-counter 44. If the interruption is made by the trailing edge of the pulse, the program goes to step #708 for doing increment of the up-counter 45. After increment of each counter 44, 45 at each step, correspondingly, the program advances to step #709. At step #709 the resister in which the state is saved at step #700 is reset to its state before the interruption.

FIG. 20 shows an interruption handling routine for making a serial communication between the CPU 49 controlling the operation of the copying machine and the aforementioned CPU 41. This interruption is made when receiving data of the serial communication through the line. At first, the state before the interruption in the resister which is used in the interruption processing is saved in the stack area at step #800, and the program advances to step #801. At step #801, it is decided whether or not a communication error such as a purity error and so on happens. When decided the error happens, the program advances to step #802. At step #802, the predetermined error correction is made, and the program goes to step #805. When decided no error happens at step #801, the program goes to step #803, and the received data is stored in a memory, and the program advances to step #804. At step #804, the data to be sent is set, and the program advances to step #805. At step #805, the resister which is saved at step #800 is reset to its state before the interruption, and the program returns.

As described above, in this embodiment, the operation modes are set by operating the encoder 35 with a manual hand operation, so that the operation for setting the operation mode is simple as well as setting of the operation mode can be made smoothly. In addition, one operation mode to be set from among five operation modes which are the copy quantity mode, the magnification mode, the paper size mode, the copy mode, and the sorter mode is properly selected. After that, setting to a desirable mode can be done by the rotary operation of the single encoder 35, so that it is possible for an unskilled person to operate easily the copying machine.

Furthermore, counting of the pulse is handle in the interruption process by inputting the encoder pulse form the encoder 35 to the terminal of the CPU 41 for the interruption, so that it is possible to control influences caused by the delay of the processing, even if making the encoder 35 rotated with a high speed. In addition, the dividing ratio of the encoder pulse is alterable, corresponding to the different width of the setting range of the operation mode to be set, for example, the one-third dividing (equivalent to a rotating speed of the encoder 35 in normal use) of the pulse for the copy quantity mode and the magnification mode, or the one-tenth dividing of the pulse for the paper size mode, the copy mode and the sorter mode, so that it can be easily done that setting to a desirable operation mode can be easily done with a rough operation to the encoder 35, in the case of setting the operation mode having a few items to be set.

Moreover, the encoder pulse is divided by the dividing ratio which is exchanged, corresponding to the result which is calculated by measuring the rotating speed of the encoder 35, in other words, measuring the pulse width of the encoder pulse by means of the pulse width timer 42, as shown in FIG. 10 which shows the subroutine of the processing to set the copy quantity or shown in FIG. 11 which shows the subroutine of the processing to set the magnification.

In case there are so many items to be set, like the copy quantity mode, there is a possibility that the processing can not follow the operation speed of the encoder 35 because of a high frequency of the pulse at the time, when the operator is going to set a desirable value with a high speed operation of the encoder. However, in this embodiment, setting of the mode is carried out depending on the addition quantity and the reduction quantity which are produced by the processing of the pulse dividing, resulting form the interruption to the CPU 41 of the encoder pulse signal, so that setting of the mode corresponding with accuracy to the rotating amount is carried out, even though the encoder 35 is rotated with a high speed.

Although, in this embodiment, the modes which are, respectively, set with the encoder pulse are the copy quantity, the magnification, the paper size, the copy mode, and the sorter mode, the modes to be set are not limited. It is adapted to setting of the following modes, for example, an exposure level, an input of coordinates for editing a copied image, and the like having modes which are rotationally selected by turns.

In connection with the above description regarding the mode to be set by the encoder, another embodiment will be disclosed below. FIG. 21 through FIG. 25 show, respectively, another preferred embodiment to which the present invention is applicable.

Figure 21:
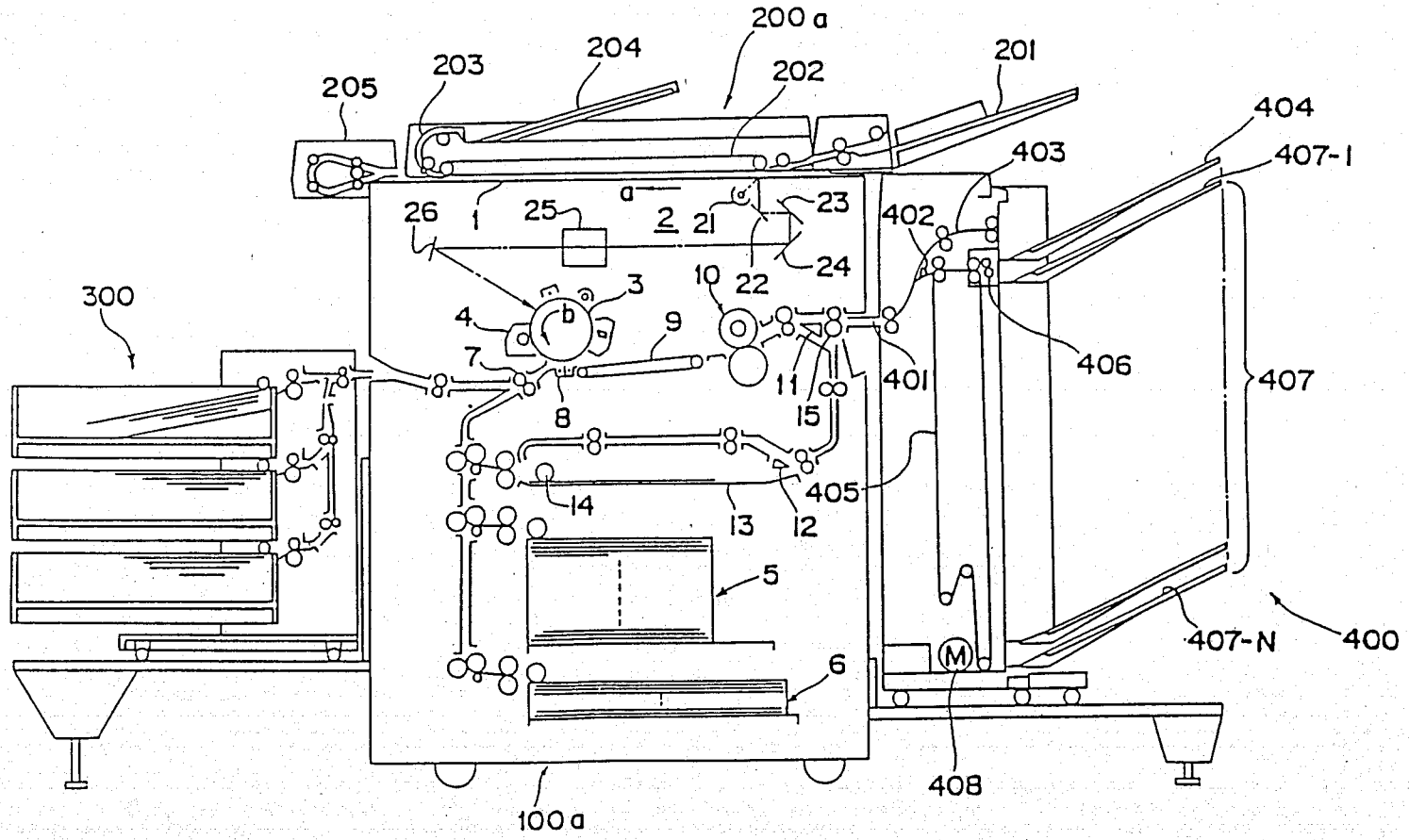
FIG. 21 is a schematic cross sectional view of another copying machine to which the present invention is applicable.
Figure 22:
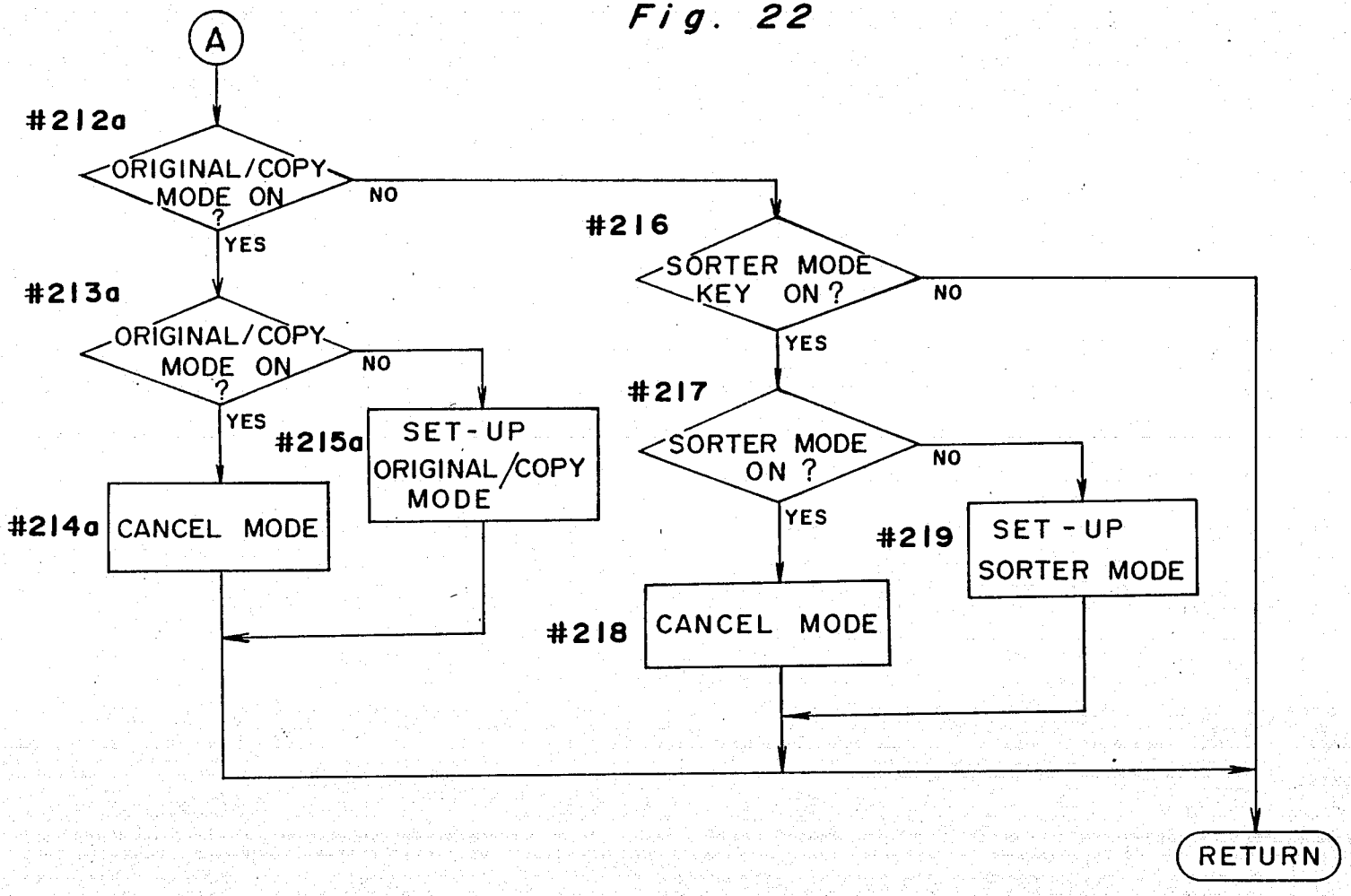
FIG. 22 is a flow chart of the operation mode selection which is partially displaced as compared with the mode shown in FIG. 8B and is applicable to the copying machine of the second embodiment in FIG. 21.
Figure 23:
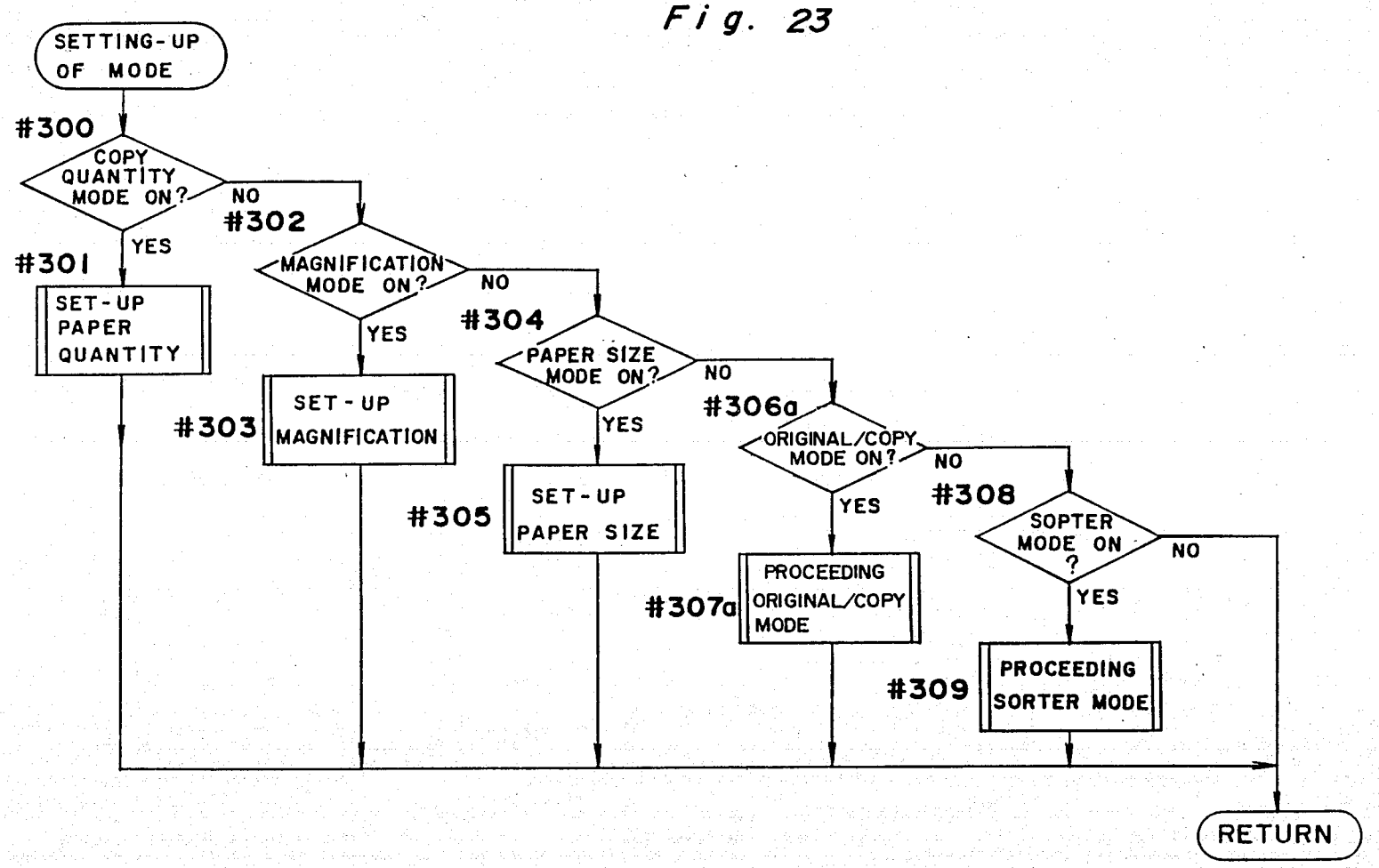
FIG. 23 is a flow chart of operation mode setting which is partially displaced as compared with the mode shown in FIG. 9 and is applicable to the copying machine of the second embodiment.

FIG. 21 shows a copying machine according to the embodiment which has one significant difference from the first embodiment previously described. One difference between the copying machine of FIG. 21 and the first embodiment of the FIG. 1 is that the copying machine has a device for reversing an original, which is designated with a reference numeral 205 in FIG. 21. The others are completely same as the copying machine of the first embodiment. In addition, in connection with the additional device described above, the program for controlling the operation of the copying machine is slightly changed. So, this embodiment will be briefly explained about the difference from the first embodiment below.

At first, the original reversing device will be explained. FIG. 21 shows the copying machine provided with the original reversing device 205. This device 205 is arranged in ADF 200*a* which is previously described. The original conveyed by the conveyor belt 202 to the device 205 is turned over here and is conveyed to the original glass plate 1 by reversing of the belt 202 and is set at the predetermined position on the original glass plate 1. After the exposure, the belt 202 is driven reversely, and the original is conveyed to the reversing device 205 and is turned over here, again, and the original is conveyed to the predetermined position on the original glass plate 1 by the belt 202 which is driven reversely and is set at its proper position on the original glass plate 1. After the further exposure, the belt 202 is driven to the normal direction, and the original is discharged t the original receiving tray 204 through the original discharging path.

If the original reversing device 205 described above is provided for the copying machine 100*a*, the duplex copy of the original can be made, with providing a proper operation mode for the original. This mode can be executed at the copy mode, in the first embodiment, previously described, providing the program of the first embodiment is slightly altered. FIG. 22 through FIG. 25 show, respectively subroutines relating to the above alteration of the program. FIGS. 22, 23, 24 and 25 are corresponding to FIGS. 8B, 9, 13 and 18. Only difference is that the "copy mode" is displaced to the "original/copy mode" (see each step number with "a" in the respective drawings). Therefore, the procedure of the processing in each subroutine is same as the previous, so that the explanation about respective subroutines is omitted, here.

Figure 24:
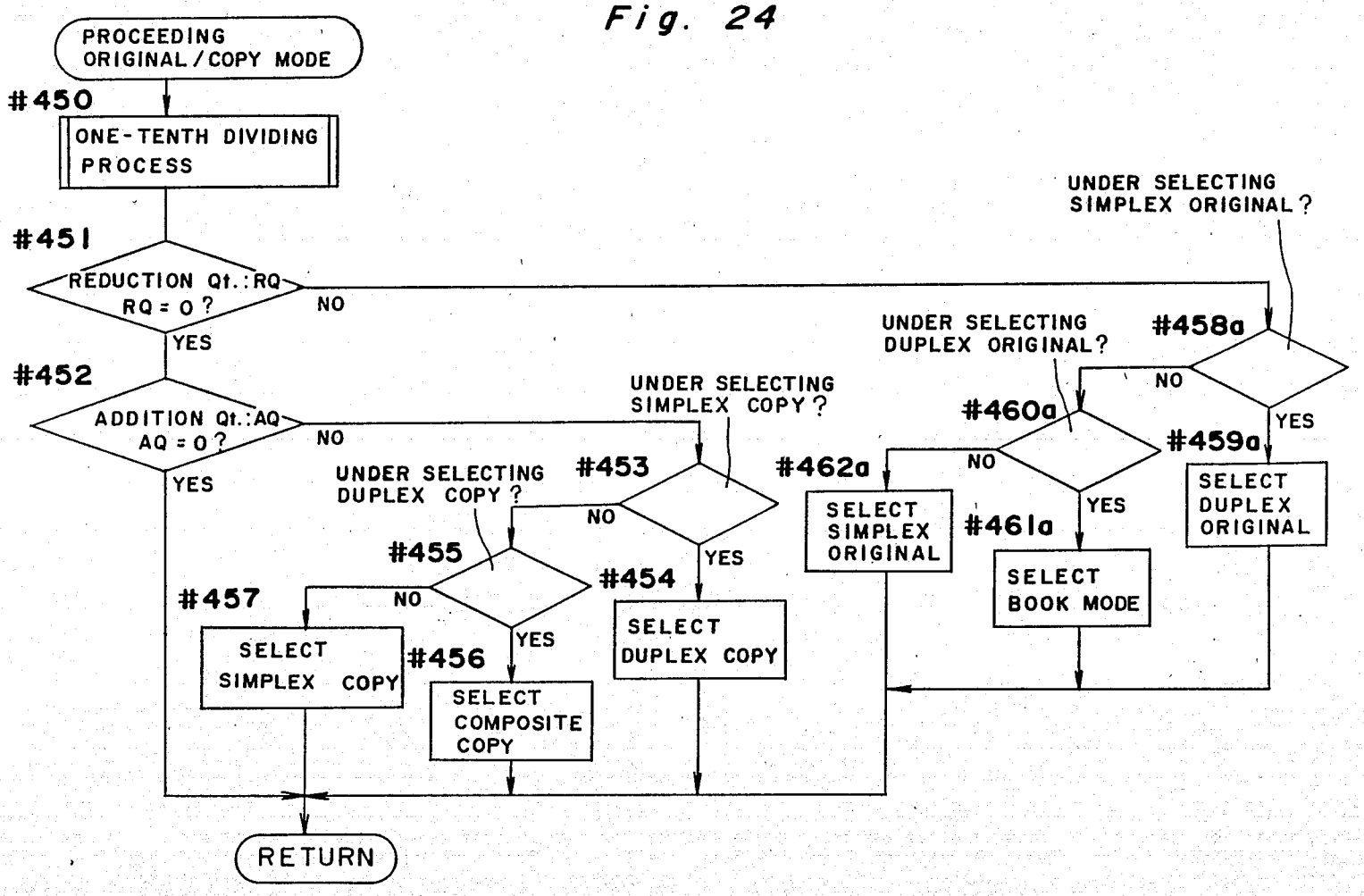
FIG. 24 is a flow chart of operation mode setting which is partially displaced as compared with the mode shown in FIG. 13 and is applicable to the copying machine of the second embodiment.
Figure 25:
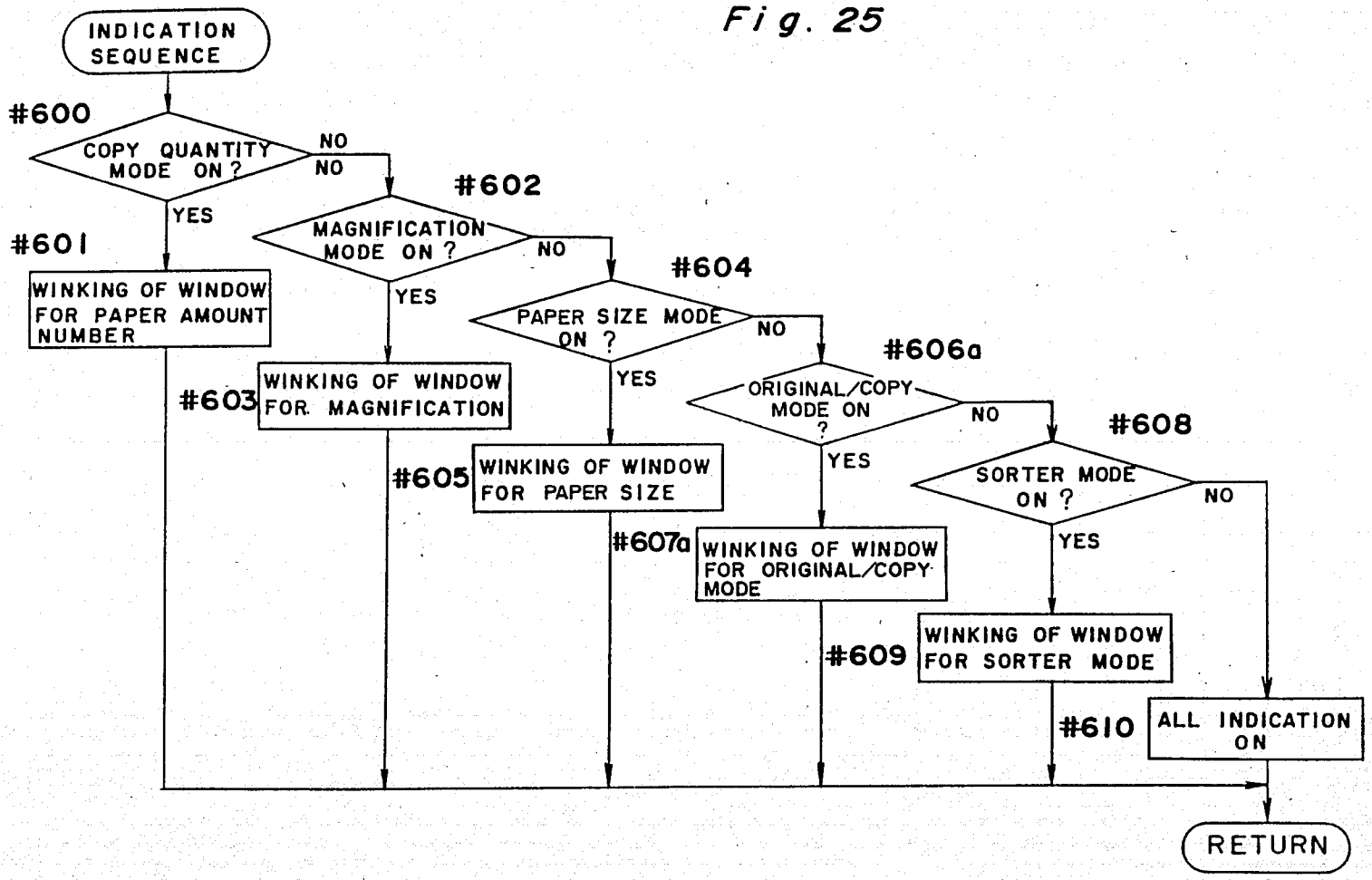
FIG. 25 is a flow chart of indication output mode which is partially displaced as compared with the mode shown in FIG. 18 and is applicable to the copying machine of the second embodiment.

In FIG. 24, the processing at respective steps from step #458*a* through step #462*a* is corresponding to the processing of the copy mode in the first embodiment previously described at the time, when the encoder 35 is so operated that it rotates in the direction of one way. So, when the encoder 35 is so operated that it rotates in the direction of the other way, the copy mode, i.e., "simplex copy"→"duplex copy"→"composite copy"→, can be carried out. The original mode includes three modes, i.e., "simplex original", "duplex original", and "book mode". So during the operation of the encoder 35 to one way direction, the original mode is switched over by turns as follows. "Simplex original"→"duplex original"→"book mode"→"simplex original"→

In this embodiment, the original/copy mode comprises two different modes which are the original mode and the copy mode, and the selection of both modes can be made at same time with one selecting key 36*d*, so that it would be possible to decrease one key for selecting the mode. In addition to the above, the above-mentioned two modes can be rapidly switched over to the desirable mode only by changing of the rotating direction of the encoder 35, for example, after selected "original/copy mode", turning the encoder 35 to the left, then exchange of the original mode can be made, or turning the encoder 35 to the right, then exchange of the copy mode can be made.

In addition to the advantages previously described, the further advantage is that a device for setting the mode can be reduced because of the functional structure of the encoder. Another advantage is that it is enabled that a plurality of mode setting can be made by one device as well as with a simple and signal operation.

Although the present invention has been fully described by way of example with reference to the accompanying drawings, it is to be noted, here, that various changes and modifications will be apparent to those skilled in the art.

For example, in the embodiment, it is so designed that the indication of the mode under selecting is flickered for a visual confirmation. However, any other methods for making a distinction from other indications are available, i.e., a way of negative/positive reversing indication, a way of color indication and etc. Furthermore, regarding the encoder, the different types of the encoder, for example, an electric type, a magnetic type, except an optical type are available.

Therefore, unless otherwise such changes and modifications depart from the scope of the present invention, they should be construed as included therein.

What is claimed is:

1. An image forming apparatus comprising:

image forming means for forming an image;

operable input means which is rotatable and is connected with a rotary encoder outputting a pulse signal in response to rotation of said operable input means;

condition setting means for setting conditions for an image formation of said image, which is carried out by said image forming means in response to said pulse signal outputted from said rotary encoder; and control means for controlling said image forming means depending on said image forming conditions set by said condition setting means.

2. An image forming apparatus according to claim 1, wherein said condition setting means includes direction detecting means for detecting a rotating direction of said operable input means depending on said pulse signal outputted from said rotary encoder, and condition altering means for altering said image forming conditions in response to said rotating direction of said operable input means.

3. An image forming apparatus according to claim 1, wherein said condition setting means includes speed detecting means for detecting a rotating speed of said operable input means depending on said pulse signal outputted from said rotary encoder, and condition altering means for altering said image forming conditions with a conversion speed corresponding to said rotating speed of said operable input means.

4. An image forming apparatus according to claim 3, wherein said condition altering means alters said image forming conditions depending on a divided pulse signal generated by dividing said pulse signal outputted from said rotary encoder by a dividing ratio corresponding to said rotating speed of said operable input means.

5. An image forming apparatus according to claim 4, wherein said image forming conditions are indicated with a numerical value.

6. An image forming apparatus according to claim 1, said image forming conditions include one condition equivalent to a number of said image formation.

7. An image forming apparatus according to claim 1, wherein said image forming conditions include one condition equivalent to a magnification for forming said image.

8. An image forming apparatus according to claim 1, wherein said image forming conditions include one condition for selecting a size of a copy paper on which said image is formed.

9. An image forming apparatus according to claim 1, wherein said image forming conditions includes one condition equivalent to a operation mode operating said image forming means, which is selected out of SIMPLEX MODES, DUPLEX MODE, and COMPOSITE MODE.

10. An image forming apparatus according to claim 1, wherein said image forming conditions include one condition equivalent to an operation mode relating to discharging of a copy paper on which said image has been formed, which is selected out of NON-SORTING MODE, SORTING MODE and GROUPING MODE.

11. An image forming apparatus comprising:

image forming means for forming an image;

operable input means which is rotatable is connected with a rotary encoder outputting pulse signal in response to rotation of said operable input means;

selecting mans for selecting a specified group from among a plurality of groups, respectively, including said image forming conditions on which said image forming means forms said image:

condition setting means for setting a desirable image forming condition for forming said image by said image forming means from among said image forming conditions being included in said specified group selected by said selecting means in response to said pulse signal outputted from said rotary encoder; and control means for controlling said image forming means depending on said desirable image forming condition set by said condition setting means.

12. An image forming apparatus according to claim 11, wherein said condition setting means includes direction detecting means for detecting a rotating direction of said operable input means depending on said pulse signal outputted from said rotary encoder, and condition altering means for altering said image forming conditions in response to said rotating direction of said operable input means.

13. An image forming apparatus according to claim 11, wherein said condition setting means includes speed detecting means for detecting a rotating speed of said operable input means depending on said pulse signal outputted from said rotary encoder, and condition altering means for altering said image forming conditions with a conversion speed corresponding to said rotating speed.

14. An image forming apparatus according to claim 13, wherein said condition altering means alters said image forming conditions depending on a divided pulse signal generated by dividing said pulse signal outputted from said rotary encoder by a dividing ratio corresponding to said rotating speed of said operatable input means.

15. An image forming apparatus according to claim 11, wherein said condition setting means includes condition altering means for altering said image forming conditions with said conversion speed corresponding to said specific group selected by said selecting means.

16. An image forming apparatus according to claim 15, wherein said condition altering means alters said image forming conditions depending on a divided pulse signal generated by dividing said pulse signal outputted from said rotary encoder by a dividing ratio corresponding to said specified group.

17. An image forming apparatus according to claim 11, wherein said groups of said image forming conditions include one group equivalent to a number of said image formation.

18. An image forming apparatus according to claim 11, wherein said groups of said image forming conditions include one group equivalent to a magnification for forming said image.

19. An image forming apparatus according to claim 11, wherein said groups of said image forming conditions include one group for selecting a size of a copy paper on which said image is formed.

20. An image forming apparatus according to claim 11, wherein said groups of said image forming conditions include one group equivalent to an operation mode operating said image forming means, which is selected out of SIMPLEX MODE, DUPLEX MODE, and COMPOSITE MODE.

21. An image forming apparatus according to claim 11, wherein said groups of said image forming conditions include one group equivalent to an operation mode relating to discharging of a copy paper on which said image has been formed, which is selected out of NON-SORTING MODE, SORTING MODE, and GROUPING MODE.

22. An image forming apparatus comprising:

image forming means for forming an image;

operable input means which is rotatable and is connected with a rotary encoder outputting a pulse signal in response to rotation of said operable input means;

detecting means for detecting a rotating direction of said operable input means depending on said pulse signal outputted from said rotary encoder;

selecting means for selecting either of two different groups, respectively, having image forming conditions on which said image forming means forms said image;

condition setting means for setting one desirable condition for forming said image from among said image forming conditions in said one group selected by said selecting means in response to said pulse signal outputted from said rotary encoder; and control means for controlling said image forming means depending on said image forming condition set by said condition setting means.

23. An image forming apparatus according to claim 22, wherein said condition setting means includes speed detecting means for detecting a rotating speed of said operable input means depending on said pulse signal outputted from said rotary encoder, and condition altering means for altering said image forming conditions with a conversion speed corresponding to said rotating speed.

24. An image forming apparatus according to claim 23, wherein said condition altering means alters said image forming conditions depending on a divided pulse signal generated by dividing said pulse signal outputted from said rotary encoder by a dividing ratio corresponding to said rotating speed of said operable input means.

25. An image forming apparatus according to claim 22, wherein said condition setting means includes condition changing means for changing said image forming conditions with said conversion speed corresponding to said group selected by said selecting means.

26. An image forming apparatus according to claim 25, wherein said condition changing means changes said image forming conditions depending on a divided pulse signal generated by dividing said pulse signal generated by dividing said pulse signal outputted from said rotary encoder by a dividing ratio corresponding to said group selected by said selecting means.

27. An image forming apparatus according to claim 22, wherein said groups of said image forming conditions include one group equivalent to a number of forming said image.

28. An image forming apparatus according to claim 22, wherein said groups of said image forming conditions include one group equivalent to a magnification for forming said image.

29. An image forming apparatus according to claim 22, wherein said groups of said image forming conditions include one group for selecting a size of copy paper on which said image is formed.

30. An image forming apparatus according to claim 22, wherein said groups of said image forming conditions include one group equivalent to an operation mode operating said image forming means, which is selected out of SIMPLEX MODE, DUPLEX MODE, and COMPOSITE MODE.

31. An image forming apparatus according to claim 22, wherein said groups of said image forming conditions include one group equivalent to an operation mode relating to discharging of a copy paper on which said image has been formed, which is selected out of NON-SORTING MODE, SORTING MODE, and GROUPING MODE.

32. An image forming apparatus comprising:

image forming means for forming an image;

operable input means which is rotatable and is connected with a rotary encoder outputting a pulse signal in response to rotation of said operable input means;

a microprocessor having an interruption terminal with which an output signal line of said rotary encoder is connected, wherein said microprocessor has means for setting one condition of an image formation to be carried out by said image forming means in response to said pulse signal outputted from said rotary encoder; and control means for controlling said image forming means depending on said image formation conditions set by said means in said microprocessor.

33. An image forming apparatus according to claim 32, wherein said microprocessor counts a number of said pulse signal when said interruption terminal receives said pulse signal outputted from said rotary encoder, and said means in said microprocessor controls said image formation conditions depending on a counting amount counted by said microprocessor.

* * * * *